US008585071B2

(12) United States Patent
Golden, Jr.

(10) Patent No.: US 8,585,071 B2
(45) Date of Patent: Nov. 19, 2013

(54) RELEASABLE FORWARD WHEEL APPARATUS FOR A WHEELCHAIR

(76) Inventor: Stephen C. Golden, Jr., Menasha, WI (US)

( * ) Notice: Subject to any disclaimer, the term of this patent is extended or adjusted under 35 U.S.C. 154(b) by 0 days.

(21) Appl. No.: 13/249,278

(22) Filed: Sep. 30, 2011

(65) Prior Publication Data

US 2012/0169026 A1 Jul. 5, 2012

Related U.S. Application Data

(63) Continuation-in-part of application No. 12/983,264, filed on Dec. 31, 2010, now abandoned.

(60) Provisional application No. 61/505,487, filed on Jul. 7, 2011.

(51) Int. Cl.
*A61G 5/10* (2006.01)

(52) U.S. Cl.
USPC ..... 280/304.1

(58) Field of Classification Search
USPC ..... 280/204, 304.1
See application file for complete search history.

(56) References Cited

U.S. PATENT DOCUMENTS

| | | | | |
|---|---|---|---|---|
| 3,679,257 A | | 7/1972 | Jacuzzi | |
| 3,876,255 A | | 4/1975 | Ilon | |
| 4,097,954 A | | 7/1978 | Christensen | |
| 4,364,580 A | | 12/1982 | Shapcott | |
| 4,432,116 A | | 2/1984 | Schultz | |
| 4,511,157 A | * | 4/1985 | Wilt, Jr. | 280/304.1 |
| D285,187 S | | 8/1986 | Piziks | |
| 4,770,432 A | | 9/1988 | Wagner | |
| 5,076,599 A | | 12/1991 | Lockett | |
| 5,116,067 A | | 5/1992 | Johnson | |
| 5,149,118 A | | 9/1992 | Oxford | |
| 5,263,729 A | | 11/1993 | Watwood | |
| 5,267,744 A | | 12/1993 | Berry | |
| 5,273,304 A | * | 12/1993 | Berkheimer | 280/304.1 |
| 5,280,937 A | * | 1/1994 | Needham | 280/259 |
| 5,320,373 A | | 6/1994 | Robertson | |
| 5,409,247 A | | 4/1995 | Robertson | |
| D365,786 S | | 1/1996 | Peterson | |
| D365,787 S | | 1/1996 | Peterson | |
| D365,788 S | | 1/1996 | Peterson | |
| 5,480,172 A | | 1/1996 | James | |
| 5,517,718 A | | 5/1996 | Eichhorn | |
| 5,586,363 A | | 12/1996 | Fanuzzi | |

(Continued)

FOREIGN PATENT DOCUMENTS

| | | |
|---|---|---|
| WO | WO-9502385 A1 | 1/1995 |
| WO | WO-9816182 A1 | 4/1998 |

OTHER PUBLICATIONS

Linghua Kong, "Introducing Asymmetry to Wheelchair Design," presented at the RESNA Annual Meeting, 2005, Atlanta, GA.

(Continued)

*Primary Examiner* — Tony Winner

(57) ABSTRACT

A releasable forward wheel apparatus for a wheelchair is disclosed wherein a pivotable caster is secured in an angularly adjustable orientation relative to a wheelchair, and wherein an opening is left on the opposing side of the wheelchair for ease of access, and wherein securing the forward wheel apparatus to the wheelchair and engaging the caster with a ground surface distributes a portion of a load supported by the wheelchair to the forward wheel apparatus.

20 Claims, 12 Drawing Sheets

(56) References Cited

U.S. PATENT DOCUMENTS

| | | | | |
|---|---|---|---|---|
| 5,681,049 | A | 10/1997 | Kim | |
| 5,689,999 | A | 11/1997 | Wiley | |
| 6,244,779 | B1 | 6/2001 | Slasinski | |
| D444,422 | S | 7/2001 | Cheng | |
| 6,443,268 | B1 | 9/2002 | Dearth | |
| D488,109 | S | 4/2004 | Koshiishi | |
| D506,165 | S | 6/2005 | Koike | |
| 7,063,344 | B2 * | 6/2006 | Pichette | 280/304.1 |
| 7,284,299 | B2 | 10/2007 | Ruckman | |
| 7,387,210 | B2 * | 6/2008 | Burrows et al. | 210/443 |
| 7,387,310 | B1 * | 6/2008 | Liu | 280/642 |
| 7,404,567 | B2 | 7/2008 | Moller | |
| 7,520,518 | B2 * | 4/2009 | Peterson et al. | 280/250.1 |
| D601,484 | S | 10/2009 | Alfonso | |
| D602,405 | S | 10/2009 | Skafdrup | |
| 7,651,103 | B1 | 1/2010 | Peridon | |
| 7,735,847 | B2 | 6/2010 | Dougherty | |
| 2006/0181051 | A1 | 8/2006 | Moller | |
| 2007/0096427 | A1 * | 5/2007 | Knaub | 280/304.1 |
| 2010/0259029 | A1 * | 10/2010 | Fast et al. | 280/304.1 |
| 2011/0221161 | A1 * | 9/2011 | Ludovici et al. | 280/250.1 |

OTHER PUBLICATIONS

InStep Sierra Double Bicycle Trailer, http://www.amazon.com/InStep-Sierra-Double-Bicycle-Trailer/dp/B002QAVQ2S, accessed Mar. 18, 2011.

"Cheetah Pediatric 3 Wheel Wheelchair," http://www.disapedia.com/index.php?title=Cheetah_Pediatric_3_Wheel_Wheelchair, dated Jul. 21, 2007, accessed Mar. 18, 2011.

* cited by examiner

RELEASABLE FORWARD WHEEL APPARATUS FOR A WHEELCHAIR

CROSS-REFERENCE TO RELATED APPLICATIONS

This application claims priority to U.S. Provisional Patent Appl. Ser. No. 61/505,487, "Asymmetric Open-Access Wheel Chair," filed Jul. 7, 2011, and is a continuation-in-part of U.S. patent application Ser. No. 12/983,264, filed Dec. 31, 2010, both of which are hereby incorporated by reference in their entireties for all purposes.

BACKGROUND

1. Field of the Invention

This invention pertains to wheelchairs, related devices, and methods for use, particularly for transportation.

2. Description of Related Art

For individuals with partial or complete impairment of motor function as a result of spinal cord injury, spina bifida, multiple sclerosis, amyotrophic lateral sclerosis, or stroke, the wheelchair is commonly an essential means of daily mobility. Two important challenges are faced by the wheelchair user in order to successfully get around in his or her environment: The act of getting oneself into the wheelchair, also termed "transferring," and the safe negotiation of indoor and outdoor surfaces alike. The act of transferring one's body into or out of a wheelchair presents a situation that often involves physical strain and awkward positioning of the arms, hands, feet, legs and torso; for many users who might wish to transfer into or out of a wheelchair with respect to a variety of different surfaces, this can severely limit the scope of physical activity. Experienced wheelchair users may wish to transfer to or from a wheelchair with respect to the ground, such as the grass at a park or a sandy beach, and this can be especially difficult even with the assistance of another person. The means of enjoying these locations is further precluded by the insufficiency of most wheelchairs to traverse these types of surfaces with safety and ease. There is a need for wheelchairs offering improved ease of transfer and which are suitable for traversing the broad range of surfaces encountered in the outdoors.

A wide variety of wheelchair designs are known, including wheelchairs with a single forward wheel such as three-wheel wheelchairs with relatively large forward wheels. Such wheelchairs can offer advantages in traversing rugged terrain, but present barriers to transferring due to the support structures holding the forward wheel in place. There is a need for rugged all-terrain wheelchairs whose support structures are minimally obstructive, thereby offering improved transferring into and out of the wheelchair.

Conventional wheelchairs, sometimes referred to as "cantilever" style wheelchairs, have relatively small forward wheels typically positioned laterally and rearward relative to the leading edge of the footrest of the wheelchair. This type of wheelchair offers the best scenario in terms of access for transferring and it may be suitable for smooth flooring and pavement but is generally unsuitable for rugged terrain. Previous attempts to make conventional wheelchairs useful on rugged terrain suffer from a variety of design challenges which can limit stability and reduce safety on very rough ground, and which may limit the overall maneuverability of the wheelchair. For users requiring stable performance on rugged terrain, there is a need for an improved wheelchair configuration.

There is a need for wheelchairs that are sufficiently robust for performance on rugged outdoor terrain yet are also lightweight, highly maneuverable and reasonably compact to allow the user to successfully negotiate tighter spaces indoors such as doorways, bathroom facilities, garages and elevators.

Even on presumably safe surfaces such as sidewalks, wheelchair users learn that they must be constantly vigilant about the upcoming surfaces since bumps, small objects, or other obstacles can cause a moving wheelchair to tip or cause the user to be propelled out of the wheelchair. There is a need for more robust wheelchairs that can remain stable and safe in spite of unevenness in the surfaces over which the wheelchair user must traverse.

Improved wheelchair designs and methods have been devised which may address one or more of these aforementioned weaknesses or other weaknesses in the prior art. Such weaknesses, however, are mentioned here only for illustrative background purposes. The embodiments hereafter described, while typically addressing one or more weaknesses in the prior art, need not directly or indirectly address all or any of the aforementioned weaknesses in the prior art to be within the scope of the various embodiments hereafter claimed. Further, any advantages stated or apparently inherent to any of the embodiments described hereafter are not intended as limitations that must necessarily be found in any or all aspects of the invention.

SUMMARY

An asymmetric wheelchair has been developed which employs a single forward wheel connected by an asymmetric support structure to a seat and rear wheel assembly, wherein the asymmetric support structure extends along a first side of the wheelchair while the opposing side of the wheelchair defines an unobstructed opening between the seat and the single forward wheel adapted for a user to pass through while transferring into or out of the wheelchair. In some embodiments, an existing wheelchair with a substantially symmetric frame is modified by the addition of an asymmetric forward wheel support that attaches to a forward side of the substantially symmetric frame. The forward wheel support holds a forward wheel assembly with a rigid structure along one side of the wheelchair, leaving the opposing side relatively open for good ease of access. The added forward wheel support may be removable and may, for example, comprise quick release connections to allow the forward wheel assembly to be readily removable or easy to install. When installed, the forward wheel assembly can share in load bearing with other forward wheels on the existing wheelchair or may be adapted to remove the load from the forward wheels and be the primary forward load bearing structure. In some embodiments, the forward wheels of the existing wheelchair may be detached from the frame.

The attachment to the forward side may be attached to a descending support of the frame. As used herein, a "descending support" can be any suitable structural element of the frame spanning a vertical distance between upper and lower elements of the frame, typified by the foremost roughly vertical beams in wheelchair frames that descend from the seat and/or arm rest regions toward the foot support region or other lower cross beams, which in many conventional wheelchairs, comprise an inward bend or taper such that portions of the descending support may not be aligned with a vertical longitudinal plane.

In one embodiment, asymmetric wheelchair is disclosed having opposing first and second sides, the wheelchair comprising:

(a) a forward wheel assembly comprising a forward wheel;

(b) opposing drive wheels on the respective first and second sides;

(c) an asymmetric frame comprising opposing first and second sides each respectively proximal to (or generally corresponding to) the first and second sides of the wheelchair, a cross member joining the first and second sides of the frame, a drive wheel assembly connected to the opposing drive wheels, and an asymmetric forward wheel support extending substantially along the first side of the wheelchair and connected to the forward wheel assembly; and (d) a seat attached to the frame and disposed between the first and second sides of the frame;

wherein the asymmetric forward wheel support leaves an unobstructed opening directed toward the second side of the wheelchair between the seat and the forward wheel assembly adapted for a user to pass through while transferring into or out of the wheelchair.

The forward wheel support may be connected by a removable and/or adjustable connection that may, for example, comprise quick release connections known, for example, in the bicycle art, and may comprise elastomeric or other deformable surfaces to contact the frame of the existing wheelchair to enhance the grip while permitting adjustability of the positioning of the forward wheel support. In one embodiment, a rubber or elastomeric sleeve encircles a portion of the existing wheelchair frame and a clamp such as the clamping mechanism in quick-release connectors clamps down on the sleeve when the forward wheel assembly is positioned in a desired orientation, thereby securing the forward wheel assembly while also allowing for rapid adjustment of position when desired by releasing the clamping force to permit relative motion of the forward wheel support. Any known quick-release systems may be used such as those known in the bicycle arts. Including those of manufacturers such as Campagnolo (Italy), XJ (China), or Ningbo Yisheng Bicycle Co. (Japan).

In one related embodiment, the forward wheel support comprises at least one arm such as a metal tubular beam that is bent or angled to provide at least about 5 degrees of curvature (e.g., the tangent at a first end of the beam defines an acute angle of at least 5 degree or more relative to the tangent at the second end of the beam), or at least about 10 degrees, such as from about 5 degrees to about 20 degrees, or from about 8 degree to about 16 degrees. In related embodiments, the arm has a first end and an opposing second end with an angle of curvature defined between the two ends. The angle of curvature may be 5 degrees or more, such as from 5 to 15 degrees.

In one embodiment, a method is provided for rapid installation and removal of the removable forward wheel support. The method comprises temporarily elevating the forward wheels of the existing wheelchair such that they are no longer load bearing. This can be done, for example, by placing a support under the front portion of the wheelchair, such as blocks that are placed under a footrest or other forward structural elements. The blocks or other elevating means can be provided as part of a kit, if desired, with the forward wheel assembly. Alternatively, a lever or other lifting mechanism may be activated to deliver sufficient upward force on the forward part of the frame to lift the wheelchair. Once the forward portion of the wheelchair is elevated, the asymmetric forward wheel support can be added to a side forward portion of the frame of the existing wheelchair, such that the wheel of the forward wheel assembly attached to the forward wheel support is suitably positioned as desired in a forward relationship to the frame of the existing wheelchair. The support structure such as blocks can then be removed and may be stored in a bag or compartment that also may be used to carry the forward wheel support when not in use. Also alternatively, the forward part of the wheelchair may be proximate to a ledge, step, or other structure providing clearance for attaching a forward wheel assembly while the existing forward wheels are on the ground bearing load, wherein once the wheelchair is suitably situated relative to the structure, the forward wheel support may be readily attached before positioned such that the attached forward wheel bears load.

In a related embodiment, the asymmetric wheelchair has opposing first and second sides and comprises:

(a) a forward wheel assembly comprising a forward wheel;

(b) opposing drive wheels on the respective first and second sides;

(c) a primary frame comprising opposing first and second sides, a cross member joining the first and second sides of the frame, a drive wheel assembly connected to the opposing drive wheels, and forward wheels connected to a forward frame element having a first and second side;

(d) an asymmetric forward wheel support connected to the first side of the primary frame, extending substantially along the first side of the wheelchair and connected to the forward wheel assembly; and (e) a seat attached to the frame and disposed between the first and second sides of the frame;

wherein the asymmetric forward wheel support leaves an unobstructed opening between the primary frame and the forward wheel assembly adapted for a user to pass through while transferring into or out of the wheelchair.

The primary frame in such embodiments may be substantially symmetric and may be the frame of conventional or other existing wheelchairs. In related methods within the scope of the present invention, an existing substantially symmetric wheelchair frame (a primary frame) is converted to an asymmetric wheelchair with a forward wheel support by attaching the forward wheel support to one side of the substantially symmetric wheelchair frame. The attachment may be adjustable and may comprise a mounting member that attaches to the primary frame with mounting elements such as quick-release clamps and receives one or more elements from a forward wheel support for secure attachment. Quick release clamps or other means may be used to secure the forward wheel support in the attachment.

Regarding the opening that is provided between forward wheel assembly and the remaining portions of the frame, the extent of the opening may be considered in terms of the horizontal distance as seen in plan view between the front edge of the seat closest to the second side of the frame and the rearmost portion of the forward wheel assembly or the rearmost portion of the forward wheel itself. That horizontal distance may be about 20 cm or more or about 30 cm or more, or may correspond to at least about one-half of the maximum width of the seat or at least about one-half of the width of the frame as measured by distance between the outer first side and the outer second side of the frame. Further, the distance from the foremost part of the second side of the frame to the rear of the forward wheel when the wheel is oriented for forward travel can be substantially unobstructed and may be at least one-fourth the distance of the first side of the frame to the second side of the frame.

In another embodiment, a method is provided to enable a wheelchair user to modify an existing wheelchair to have an asymmetric forward wheel assembly, the existing wheelchair comprising a first side and a second side, rear wheels, forward wheels, a primary frame connected to the rear wheels and the forward wheels, the primary frame having a forward portion having a first forward side and a second forward side, the method comprising:

(a) providing a forward wheel support having a forward end attached to a forward wheel assembly and a rear end, the forward wheel assembly comprising a forward wheel; the rear end comprising a removable attachment for connecting to the primary frame, such that when attached to the primary frame, an asymmetric (b) providing instructions to the user regarding attachment of the forward wheel support to either the first or second forward side of the forward portion of the primary frame to provide an asymmetric wheelchair.

The aforementioned method can be used to enable a user to rapidly convert a conventional wheelchair having two forward casters (front casers) into an asymmetric wheelchair of the present invention. The instructions provided to the user can be delivered by any known means, such as printed directions, graphical displays or other indicia on or associated with the wheelchair, verbal directions, and the like.

In another embodiment, an asymmetric wheelchair is disclosed comprising:

(a) a forward wheel assembly comprising a caster, (b) a frame assembly having a front, opposing first and second sides, and a longitudinal central vertical plane passing between the first and second sides, comprising:

i. a first side member having a first drive wheel support, ii. a second side member having a second drive wheel support and a front, iii. a cross member joining the first side member to the second side member, iv. a forward wheel support connected to the frame (e.g., attached to one of the first and second side members of the frame) extending forward substantially beyond the front of the first side member, the forward wheel support being connected to the forward wheel assembly and being asymmetric relative to the longitudinal central plane of the frame assembly, such that a substantial opening is provided between the second side member and the forward wheel assembly in contrast to the obstruction provided by the forward wheel support between the first side member and the forward wheel assembly, and (c) first and second drive wheels attached, respectively, to the first and second drive wheel supports of the frame assembly.

As used herein, a "descending support" can be any suitable structural element of the frame spanning a vertical distance between upper and lower elements of the frame, typified by the foremost roughly vertical beams in wheelchair frames that descend from the seat and/or arm rest regions toward the foot support region or other lower cross beams.

The opening provided between the seat and the forward wheel assembly may have a horizontal span of at least 20 cm, 30 cm, 50 cm, or 70 cm at any vertical elevation. The opening may be expressed in terms of the width of the wheelchair's frame or seat to better to accommodate the range of wheelchair sizes known in the art. Thus, the horizontal space between the front edge of the seat and either of the rearmost portion of the forward wheel assembly or the rearmost portion of the forward wheel may correspond to at least one half of the frame width, taken as the distance from the outside of the first side of the frame to the outside of the opposing second side of the frame), or it may correspond to at least about one half of the maximum seat width (the greatest width of the seat). For a wheelchair designated as having a seat width of 40 cm, for example, the opening provided between the seat and the forward wheel assembly in plan view may have a horizontal span of at least 20 cm, and may be 30 cm, 50 cm, or even 70 cm at any vertical elevation, such as from about 20 cm to 100 cm or from 25 cm to 75 cm. The asymmetric wheelchair may further comprise a back support attached to the frame assembly and a foot support attached to the frame assembly.

Unlike known three-wheeled wheelchairs with generally symmetric supports extending from the sides of the frame and/or central supports extending along the centerline of the wheelchair between the seat region and a third wheel, the present wheelchair provides an asymmetric design that leaves a substantial opening along one side of the structure through which a typical user can pass in the course of entering or exiting from the wheelchair. In some embodiments, the central forward region between the forward wheel and the main body of the frame (e.g., the seat support and adjacent structures, excluding the forward wheel support) is free of rigid support elements connecting the forward wheel to the main frame such that user can pass through the forward central region in the process of entering or exiting from the wheelchair. In some embodiments, the extent of the opening between the forward wheel assembly and the side of the seat opposite the side along which the forward wheel support extends is at least 50% of the width of the seat, more specifically at least about 70% of the width of the seat, and most specifically at least about 100% of the width of the seat. Seat widths can be any suitable width, but may, for example, range from 20 cm to 100 cm such as from about 30 cm to about 60 cm. Alternatively, the breadth of the opening between the forward wheel assembly and the side of the seat opposite the side along which the forward wheel support extends may be at least about any of the following: 20 cm, 40 cm, 60 cm, 80 cm, 100 cm, and 120 cm. In some embodiments, the stated clearance may be found at all vertical elevations, such that, for example, a person of any height could stand in the opening between the seat and the forward wheel assembly due to the asymmetric placement of the forward wheel support. However, it is also recognized that an asymmetric wheelchair according to various embodiments may have additional elements present such as an overhead covering to protect against sun or rain, other decorative or functional elements, and the like, while still leaving a useful opening between the forward wheel and the seat on a side opposite the asymmetric forward wheel support. It is also recognized that the forward wheel support element need not take a simple, direct path from first side of the wheelchair toward the forward wheel assembly, but may follow more complex paths provided that an opening is maintained on one side of the wheel chair between the region of the seat or immediately in front of the seat and the forward wheel assembly.

Many elements of conventional wheelchairs and principles of constructing the frame, drive wheel assemblies, and other components may be adapted for use in the present asymmetric wheelchair. For example, the drive wheel assemblies and related frame elements of U.S. Pat. No. 7,520,518, "Wheelchair," issued Apr. 21, 2009 to Peterson and Cerreto, herein incorporated by reference to the extent that it is noncontradictory herewith, may be of use. Other patents describing various components of wheelchairs can be adapted for use with the asymmetric wheelchair described herein, including those cited herein.

In some embodiments, known wheelchairs such as cantilevered wheelchairs with opposing forward casters or other designs may be retrofitted or otherwise converted into asymmetric wheelchairs with a forward wheel assembly supported by a forward wheel support extending from only one side of the wheelchair to leave an opening along the other side between the frame and the forward wheel assembly to facilitate transfer into or out of the wheelchair. For a generally symmetric wheelchair comprising a frame having first and second sides, opposing drive wheels attached to the first and second sides of the frame, and opposing forward casters attached to the first and second sides of the frame, a method of converting the symmetric wheelchair to an asymmetric wheelchair may comprise asymmetrically attaching a forward wheel support to the first side of the frame, the forward wheel support being connected to a forward wheel assembly comprising a caster, wherein the asymmetrically attached forward wheel support leaves a substantial opening between the second side of the frame and the forward wheel assembly. The forward wheel support may be at least one of removably or adjustably attached to the frame, or it may be permanently attached (e.g., by welding). Removable or adjustable attachment means may include releasable clamps, attachment plates with bolts or other locking means, locking hinges, screw-on attachments, snap-on connectors, etc. Tubes or rods that fit into existing hollow beams in the frame of the symmetric wheelchair may also be use to attach the forward wheel support to the frame. Locks, snaps, latches, and other means may be used to securely attach the beams or rods of the forward wheel support that may fit inside beams, tubes, or other openings or receptacles in the symmetric wheelchair. Combinations of attachment means may be used. The converted asymmetric wheelchair may then have a substantial opening between the second side of the frame and the forward wheel assembly, and may, for example, have a horizontal extent of at least 20 cm at any elevation.

The frame of the wheelchair may be made of any suitable material such as tubing including cylindrical, oval, or rectangular tubing in cross section. Beams of any cross section may be used. Metal may be used for all or part of the frame, such as aluminum, magnesium, steel, titanium, tungsten, or alloys thereof or of any other useful metals. Load-bearing elements and other portions of the frame may also be made of plastics, wood, composites such as fiber-reinforced resins, wood laminates, carbon fiber composites, fiberglass, nanocomposites, honeycomb panels, and the like. Side portions, seat supports and other elements of the frame in various embodiments may be substantially open (e.g., having significant open space between tubing or beams providing structural elements) or may be substantially closed such as solid composite boards or panels.

The frame may be rigid or foldable. Locking hinges or other locking elements may be used to provide foldable embodiments in which the forward wheel support or other elements can fold to reduce the space occupied by the wheelchair for transporting in a vehicle, storage, etc. Foldable frames may include locking hinges or other locking elements such as those used in the Activator™ wheelchair of Mobility Vision (Dublin, Ireland); the Varilock™ hinges or the Infinilok™ hinges of Adjustable Locking Technologies, LLC (Bloomfield Hills, Mich.); or the systems described, for example, in U.S. Pat. No. 6,244,779, "Angularly Adjustable Coupling," issued Jun. 12, 2001 to M. Slasinski; U.S. Pat. No. 5,586,363, "Indexing Hinge," issued Dec. 24, 1996 to J. M. Fanuzzi; U.S. Pat. No. 5,689,999, "Adjustable Rotary Unlocking Apparatus," issued Nov. 25, 1997 to R. A. Wiley et al.; United States Patent; U.S. Pat. No. 3,679,257, "Foldable Wheel Chair," issued Jul. 25, 1972 to Jacuzzi et al.; and U.S. Pat. No. 4,770,432, "Wheelchair," issued Sep. 13, 1988 to K. E. Wagner (a patent which also discusses the use of panels as structural elements for a frame); all of which are herein incorporated by reference to the extent that they are noncontradictory herewith. Such locking hinges or other locking elements may also be incorporated in various embodiments other than folding wheelchairs, and may be used, for example, to allow one or more components of the asymmetric wheelchair to be adjustable in position. Thus, for example, a locking hinge or adjustable coupling may be used to adjust the position of the forward wheel assembly by adjusting the length of the forward wheel support that extends in front of the seat or in front of the foot support. For example, the forward wheel support may be mounted to a side of the frame by a slidably adjustable coupling with pins or other locking elements to secure the forward wheel support rigidly in place at a desired position. Hollow receiving tubes in the frame, for example, may be used to receive the forward wheel support in a slidably adjustable relationship.

An adjustable coupling or locking hinge may also be used, in some embodiments, to adjust the position of the forward wheel assembly relative to the longitudinal centerline of the asymmetric wheelchair by adjusting the path (i.e., the inward deviation relative to the first side of the frame) of the forward wheel support. Thus, an adjustable coupling may provide for a selection of two or more positions of the forward wheel assembly relative to the longitudinal centerline of the wheelchair, such that the forward wheel assembly can be adjusted to be in the vertical plane of the longitudinal centerline or offset laterally from the centerline, if desired.

Likewise, the forward wheel support may be unitary with the frame or may be attached via adjustable couplings, or may comprise one or more locking hinges to permit folding of the frame into a compact form for ease of transport or storage.

The forward wheel can be any known wheel system compatible with a wheelchair having a forward wheel. Wheels may have a center rotating hub or bearing and a compliant material on its outer periphery such as rubber, neoprene, urethane, or related elastomeric compounds. Wheels may be pneumatic (e.g., filled with air, nitrogen, or other gases), filled with a foam, filled with a liquid or slurry, or may be semi-pneumatic, solid, or the like. A wheel may be supported from one or both sides of an axle through the wheel or by any other suitable means. The forward wheel assembly may comprise only one wheel or two or more wheels.

In many embodiments, the forward wheel assembly comprises a caster. A caster wheel is generally understood to be a wheel in which the wheel's axle (which defines its axis of rotation) is mounted to a wheel mount, which is pivotable about a vertical pivot axis, with the wheel's axle offset horizontally from the wheel mount's pivot axis. This geometry provides a stable arrangement in which the wheel's axle will tend to trail the pivot axis when a horizontal motive force is applied to the mount, the axle tending to align perpendicularly to the direction of motion such that the wheel itself is generally aligned with the direction of motion. The pivot axis may be defined by a swivel joint that allows the wheel mount to swivel. The swivel joint may allow 360-degree rotation or may limit the scope of rotation about the pivot axis to some predetermined range. The swivel joint may be dampened or controlled in various ways to reduce caster flutter at elevated speeds.

In a caster, the wheel may be mounted to a fork, with opposing fork elements on both sides of the wheel attached to the hub of the wheel. The wheel may also be mounted at the side of the wheel without the need for a fork to descend on both sides of a wheel. For example, a wheel mount may be joined to a double wheel with a wheel on both sides of a central wheel support, as shown, for example, in FIG. 1 of U.S. Pat. No. 5,517,718, "Caster Assembly with Automatic Swivel Lock/Unlock," issued May 21, 1996 to A. E. Eichhorn, herein incorporated by reference to the extent that it is noncontradictory herewith. Thus, a forward wheel assembly can comprise a double wheel or a plurality of wheels or rollers, if desired. Double or compound wheels may be used, as well as spherical wheels (an omni-directional wheel). Complex compound wheels may be used such as a Mecanum wheel, also known as a Swedish wheel or lion wheel, made of a large hub with many additional smaller wheels mounted along the perimeter such that their axes are perpendicular to the central wheel, such as the wheel described in U.S. Pat. No. 3,876,255, "Wheels for a Course Stable Self-Propelling Vehicle Movable in Any Desired Direction on the Ground or Some Other Base," issued to B. E. Hon, Apr. 8, 1975, herein incorporated by reference to the extent that it is noncontradictory herewith. The forward wheel assembly itself may be substantially symmetrical or asymmetrical.

The drive wheels (rear wheels) of the wheelchair may be of any known design and may be solid, pneumatic, semi-pneumatic, foam filled, and the like. They may be of any width, made of any suitable material, with any suitable tread, and may have a secondary rim for ease of gripping. They may be cambered on individual axes that attach to a camber tube connected to the frame, or they may be free of camber. As used herein, "camber" refers to the angle of the plane of the wheel relative to vertical. If the top of the wheel is farther out than the bottom (that is, away from the axle), it is called positive camber; if the bottom of the wheel is farther out than the top, it is called negative camber. Negative camber is often used in wheelchairs for athletic purposes, for example, with an absolute magnitude of from about 1 to about 20 degrees, for example, though camber need not be present.

Drive wheels may also be fully manual, fully motorized, have motor assist, or have gears or other mechanical or electrical systems to assist in driving them. For example, the Wijit® by Superquad Corp. (Granite Bay, Calif.) may be attached to one or both wheels to allow leveraged driving and braking by manual force applied to the lever arms of the Wijit®. Further information is provided in U.S. Pat. No. 5,263,729, "Wheelchair Driver and Braking System," issued Nov. 23, 1993 to Watwood and Armstrong, herein incorporated by reference to the extent that it is noncontradictory herewith. An example of a drive motor attached to a wheelchair is discussed in U.S. Pat. No. 7,651,103, "Wheelchair," issued Feb. 9, 2007 to M. Peridon, herein incorporated by reference to the extent that it is noncontradictory herewith.

DETAILED DESCRIPTION OF THE DRAWINGS

Figure 1:
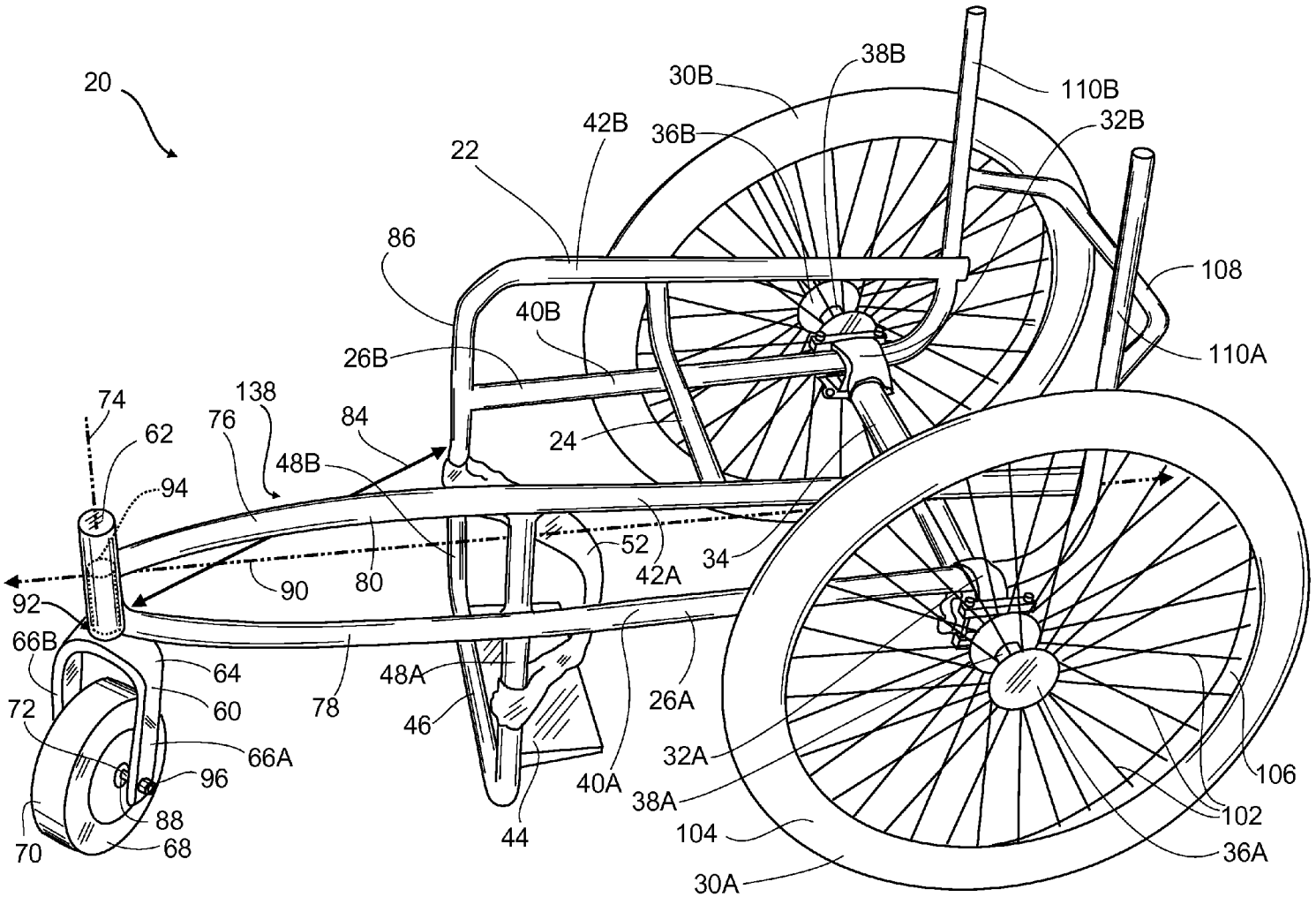
FIG. 1 depicts a view of one embodiment of the asymmetrical wheelchair.

FIG. 1 depicts a wheelchair 20 comprising a frame 22, opposing first and second drive wheels 30A, 30B, connected to the frame 22 via drive wheel assemblies 32A, 32B retaining an axle tube 34 for receiving projecting portions (not shown) of the axles 38A, 38B extending from the respective hubs 36A, 36B of the drive wheels 30A, 30B. The frame 22 further comprises first side 26A and a second side 26B joined by a cross member 24 generally passing substantially beneath the upper elements 42A, 42B of the respectively first and second sides 26A, 26B on which a seat (not shown) can be attached, typically using mechanical fastening means (not shown) such as hook-and-loop fasteners, snaps, straps, or other means supporting a seat cushion (not shown) or other seating element. Thus, the cross member 24 generally passes beneath the typical locus of a seat.

A foot rest 44 may be attached to a foot support element 46 connected to first and second sides 26A, 26B by descending supports 48A, 48B, which can be generally vertical structural elements descending from upper portions of the frame to provide support for the foot rest 44 or associated lower members. A leg restrainer 52 such as a flexible member made from cloth or other flexible elements may be connected to the descending supports 48A, 48B at a vertical elevation above the foot rest 44. In this embodiment, the forward edge of the foot rest 44 and the foot support element 46 are substantially remote from the forward wheel 68, with a space therebetween that can be, for example, at least about 20 cm. In other words, a clearance of at least 20 cm extends between the foot rest 44 and the forward wheel 68.

A forward wheel assembly 60 is connected to the frame 22 via a forward wheel support 76 extending forward from the first side 26A of the frame 22, unlike the second side 26B of the frame 22 which does not have a similar forward extending element connected to the forward wheel assembly 60. Rather, a gap 84 is defined by the space in the asymmetric forward opening 138 between the front 86 of the second side 26B of the wheelchair 20 and the forward wheel assembly 60, providing a space for ease of entry or exit of a user into and out of the wheelchair 20. The length of the gap 84 may be, for example, at least about 20 cm, 30 cm, 50 cm, 70 cm, or 80 cm, such as from about 20 cm to about 100 cm or from 35 cm to 85 cm.

The asymmetric forward wheel support 76 in the embodiment pictured comprises an upper beam 80 and a lower beam 78 both joined to descending supports 48A. The asymmetric forward wheel support 76 projects forward from the first side 26A of the wheelchair and may extend laterally inward toward the longitudinal centerline 90 of the wheelchair.

The forward wheel assembly 60 comprises a caster 64 having a wheel 68 mounted between two opposing forks 66A, 66B. The wheel 68 has an outer layer 70 such as rubber or other suitable material, a hub 88, and an axle 72 that engages with the forks 66A, 66B of the caster 64, and retained in place by locking nuts 86 or other means. (Of course, the caster 64 shown here is by way of example only, for many other forms are possible for the forward wheel assembly 60, including versions without opposing forks 66A, 66B or with more than one wheel 68, as well as versions with many variations in shape and size, etc.) The caster 64 is connected to the forward wheel support 76 to form a pivot joint 92. In this case, a pivot rod 94 extends upward from the caster 64 and is received by a caster mounting element 62. Bearings, lubrication means, retaining means, shock absorption elements, and other elements known for casters 64 are not shown but are well known in the art and may be applied, as desired.

In some embodiments, the pivot axis 74 may pass through or be near to the longitudinal central axis 90 of the wheelchair 20, or may be offset toward the first or second sides 26A, 26B. The forward wheel assembly 60 may be symmetrically positioned with respect to the seat (not shown) and drive wheels 30A, 30B, but the wheelchair 20 itself in that case is asymmetric due to the asymmetric placement of the forward wheel support 76, which extends along only one side of the wheelchair 20 in the space between the forward wheel assembly 60 and the front 86 of the side 26B of the wheelchair 20 opposite to the side 26A along which the forward wheel support 76 primarily extends forward.

The frame 22 may further comprise additional elements such as a rear cross member 108 bridging opposing vertical members 110A, 110B, each joined to the other structural elements of the frame 22 such as the lower elements 40A, 40B respectively of the first and second sides 26A, 26B. The opposing vertical members 110A, 110B may serve to support a backrest, handles (not shown) for pushing the wheelchair 20, a backpack (not shown) or other additions.

The drive wheel assemblies 32A, 32B shown in FIG. 1 are attached to the lower elements 40A, 40B of the frame, and are depicted as clamp-on elements holding the axle tube 34, which can be any element or elements for receiving axles 38A, 38B of the drive wheels 30A, 30B, including individual camber tubes (not shown). The drive wheel assemblies 32A, 32B may be formed with, built in, or, in general, unitary with the respective first and second sides 26A, 26B of the frame 26, or may be separate elements that can be readily attached and removed. Many alternative configurations may be considered, including axle plates (not shown) and other devices known in the art for attaching wheels 30A, 30B to a wheelchair 20.

The drive wheels 30A, 30B can be of any known configuration, such as the depicted versions which include drive wheel hubs 36A, 36B from which spokes 102 extend to a rim 106, which is joined to an outer layer 104 that may comprise rubber or other compliant materials. The drive wheels 30A, 30B can have any suitable width, diameter, tread type, tread material, and interior structure, including air-filled, foam-filled, solid, liquid-filled, and the like.

In alternative embodiments, the axle tube 34 may be replaced by separate axle tubes (not shown) on each side of the frame 22, though an axle tube 34 as shown or other member (not shown) joining the first and second sides 26A, 26B of the frame 22 can add stability and strength to the frame 22.

The dimensions of the wheelchair 20 can be varied to meet the needs of individual users or to meet other design and usage considerations. In some embodiments, the extend of the clearance and the locations of various components of the wheelchair can be optimized to provide for convenient movement in and out of the wheelchair with respect to the ground, chair, a sofa, a bench, an automobile, a bed, or other objects and devices (not shown). Several considerations may come into play in selecting useful dimensions. In some embodiments, for example, if the forward wheel assembly 60 comprises a caster 64, as it does in the embodiment shown in FIG. 1, then when the caster 64 is trailing the pivot axis 74 (typical for generally forward motion of the wheelchair 20), sufficient clearance between the caster 64 and the foot support element 46 or main body of the frame 22 may be provided to allow both feet (not shown) of a user (not shown) to passively pivot on the ground surface when the user is transferring into or out of the wheelchair 20. For example, for a user with a shoe (not shown) length of 30 cm (or, more generally, a length of "SL"), for example, the clearance 112 between the rear of the caster 64 and the foot support element 46 or the foot rest 44 itself, whichever is foremost, may be at least about 24 cm (or, more generally, at least about 0.8 SL). When the caster 64 is oriented away from the frame 22 in the orientation generally assumed when the wheelchair 20 is moving backward, the clearance 112 between the caster 64 and the foot support element 46 may be 36 cm or greater (or, more generally, at least about 1.2 SL). Similar clearance lengths may be realized for the clearance between the front 86 of the second side 26B and the rearmost portion of the caster 64.

The dimensions of the wheelchair 20 may also be adapted such a user sitting in the wheelchair 20 may be able to reach far enough forward to be able to turn a door knob or similar handle (not shown) and also be able to push or pull a door (not shown) open or closed. As a general guideline for this scenario, assuming the user is able to lean his/her body forward enough to bring the shoulders above the front edge of the seat (not shown) or the beyond the front 86 of the second side 26B of the wheelchair 20, the distance from the front edge of the seat or the front 86 of the second side 26B of the wheelchair 20 to the vertical pivot axis 74 of the caster may be roughly equal to the distance from the user's shoulder joint to the wrist (or may be roughly equal to that distance plus or minus about 20%). The length of the hand (not shown) may then extend longitudinal in front of the pivot axis 74 to allow the user to operate a door knob or similar handle. For example, for a user with a shoulder-to-wrist length of about 56 cm and a hand length of about 20 cm, a distance from the front edge of a seat cushion (not shown) to pivot axis 74 of about 55 cm may, for example, be useful in allowing the user to readily operate door handles or other devices while in the wheelchair 20.

Figure 2:
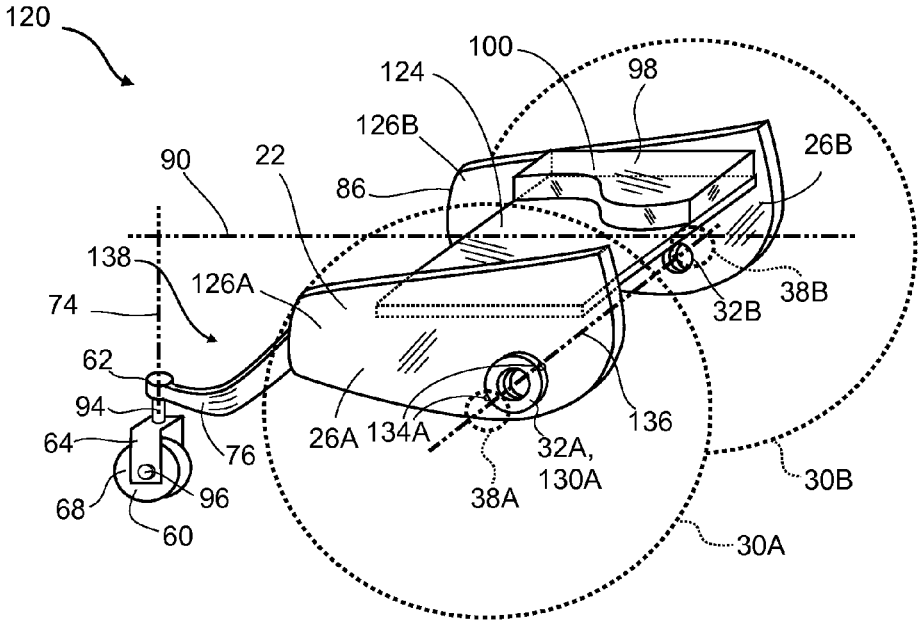
FIG. 2 depicts selected elements of an asymmetrical wheelchair.

FIG. 2 depicts a simplified asymmetrical wheelchair 120 showing selected elements to illustrate various embodiments. Here and in other figures, identical numbers depict related elements. Thus, as in FIG. 1, the simplified wheelchair comprises a frame 22 having a first side 26A and an opposing second side 26B, a forward wheel support 76 extending asymmetrically from one side, here the first side 26A, and connected also to a forward wheel assembly 60 comprising a wheel 68 held in a caster 64 or other pivotable configuration, here shown with locking nuts 96 retaining the wheel 68 within the body of the caster 64, the caster 64 also having a pivot rod 94 that engages with a caster mounting element 62 at the forward end of the forward wheel support 76 in a pivotable relationship, such that the caster 94 can freely swivel during forward or reverse motion of the wheelchair 120. The wheelchair 120 also comprises opposing drive wheels 30A, 30B which are not shown except as phantom lines for simplicity.

In the embodiment shown in FIG. 2, the first and second sides 26A, 26B are depicted as comprising relatively solid first and second side members 126A, 126B instead of relatively open beams. Such side members 126A, 126B could be, for example, composite panels, molded reinforced plastic, honeycomb panels of metal or other materials, and the like, or covered beams or other structural elements.

A seat 98 is shown comprising a cushion 100 in a cutaway view to reveal an underlying cross panel 124 which serve, for example, as both a cross member structurally similar to cross member 24 of FIG. 1, and/or as a seat support to retain the cushion 100. If the purpose of the cross panel 124 is primarily to support the cushion 100, then an additional cross-beam (not shown) may be needed underneath the cross panel 124.

The side members 126A, 126B are connected to respective drive wheel assemblies 32A, 32B for engaging drives wheels 30A, 30B, respectively. The drive wheel assembly 32A for the first side member 126A is depicted as having an annual axis plate 130A with connecting pins 134A for releasably engaging the axle (not shown) of the drive wheel 30A. The corresponding components of the drive wheel assembly 32B of the second side member 126B are not shown for simplicity. The hubs 36A, 36B of the drive wheels 30A, 30B can be aligned along a common drive wheel axis 136, as shown.

The forward wheel assembly 60 may be positioned along the longitudinal centerline 90 of the simplified wheelchair 120, or in other words, a vertical plane passing through the longitudinal centerline 90 will intersect the forward wheel assembly 60. The pivot axis 74 of the forward wheel assembly 60 may then intersect a longitudinal centerline 90 passing, for example, through the cross panel 124 as depicted. While the angle of intersection of the pivot axis 74 and the horizontal longitudinal centerline 90 is shown to be approximately 90 degrees, it need not be 90 degrees. The pivot 74 axis can be offset from vertical as desired. For example, the pivot axis 74 may tilt toward the seat 98 to define an angle relative to vertical of from about 0 to about 45 degrees, such as from about 5 degrees to about 40 degrees or from about 10 degrees to about 30 degrees.

As in FIG. 1, the embodiment depicted in FIG. 2 provides a clearance between the forward wheel assembly 60 and the front 86 of the second side member 126B of the wheelchair 120 defining a substantial asymmetric forward opening 138. The asymmetric forward opening 138 can be useful in facilitating ease of entry and exit for a user (not shown).

The simplified wheelchair 120 is not shown with a variety of elements that can be added as desired, such as a footrest (not shown) and back support (not shown).

Figure 3:
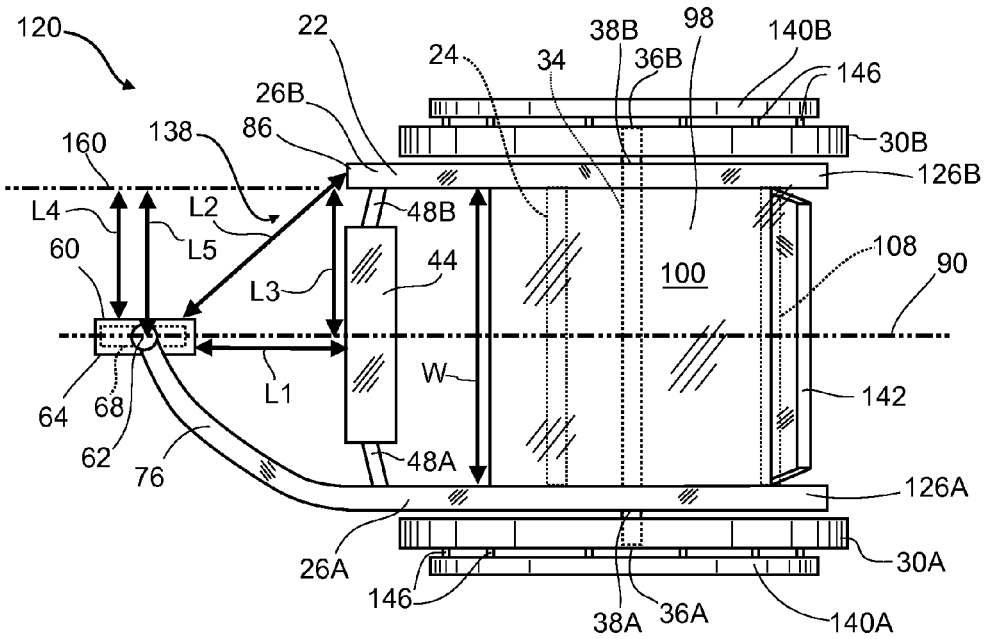
FIG. 3 depicts a top view of one embodiment of an asymmetric wheelchair with a forward wheel assembly connected to one side of a frame.

FIG. 3 depicts a top view of one embodiment of an asymmetric wheelchair 120 with a forward wheel assembly 60 connected to one side of a frame 22. The wheelchair 120 is similar to that shown in FIG. 2, but also has a back support 142 that was not shown in FIG. 2 for clarity. A frame 22 has a first side 26A and a second side 26B each connected to first and second drives wheels 30A, 30B, respectively, via axles 38A, 38B extending from the drive wheel hubs 36A, 36B, respectively, to engage an axle tube 34 or related drive wheel assemblies (not shown). The drive wheels 30A, 30B may comprise push rims 140A, 140B, respectively, which are external rims attached via push rim mounts 146 to the wheels 30A, 30B for more convenient manual pushing and control of motion. The axle tube 34 could be a camber tube (though essentially zero camber is depicted) if desired. An axle tube 34 need not rigidly join the first and second sides 26A, 26B and is optional in various embodiments. First and second sides 26A, 26B are joined by a cross member 24 and optionally may be further joined by a rear cross member 108. Above the cross member 24 is a seat 98 attached to the frame 22 and comprising a cushion 100. A back support 142 may also be attached to the rear of the frame 22 or to the seat 98. Toward the front of the frame, a foot support 44 may be attached to the first and second sides 26A, 26B by descending supports 48A, 48B, respectively.

Extending forward from the first side 26A of the frame 22, a forward wheel support 76 is connected to a caster mounting element 62 that is attached to a pivotable forward wheel assembly 60. The caster mounting element 62 may be unitary with the forward wheel support 76 and may form its foremost element. The forward wheel assembly 60 comprises a caster 64 having a wheel 68 (there may be more than one wheel 68). The caster 64 is generally understood to be a swivel caster 64, though it should be understood that a forward wheel assembly 60 with a wheel 68 that cannot pivot is not necessarily outside the scope of certain embodiments of the invention as defined by the claims.

In the top view presented in FIG. 3, the asymmetric clearances provided by the asymmetric wheelchair can be readily observed. While forward wheel support 76 provides some degree of obstruction on the first side 156A of the wheelchair 120, on the opposing second side 156B the space between the front 86 of the second side 26B of the frame 22 and the forward wheel assembly 60 is relatively unobstructed, defining an asymmetric forward opening 138. The unobstructed space has a length of L2 as shown. The unobstructed space along the horizontal longitudinal centerline 90 between the foot support 44 and the forward wheel assembly 60 (which is not necessarily centered on the horizontal longitudinal centerline 90 but is so depicted in FIG. 3) has a length of L1 as shown. Also shown is L3, the distance from the second side longitudinal axis 160 extending forward from the inner edge of the second side 26B of the frame to the longitudinal centerline 90, and L4, the distance from the second side longitudinal axis 160 and the forward wheel assembly 60 when it is oriented in the normal direction for forward motion of the wheelchair 120. L5 is the distance from the second side longitudinal axis 160 to the center of the caster mounting element 62. A reference dimension for characterizing other dimensions in relative terms is the characteristic width W between the inner surfaces of the first and second sides 26A, 26B of the frame 22, generally corresponding to the maximum width of a rectangular seat 98 that can be accommodated in the wheelchair 120. When the forward wheel assembly 60 is centered, L5 should normally be 0.5 W, for example.

Dimensions L1 and L2 can be useful is characterizing the clearances provided by the novel asymmetric design of the wheelchair. L1, for example, can be greater than about 0.4 W, and may range from about 0.5 W to about 2 W or from about 0.7 W to about 1.8 W. L2, also by way of example, can be greater than about 0.5 W, and may range from about 0.6 W to about 2.4 W or from about 0.7 W to about 2 W, or from about 0.8 W to about 1.5 W. When the forward wheel assembly 60 lies on the horizontal centerline 90, L4 should be less than 0.5 W, but offset locations may also be contemplated. L4 may, for example, range from about 0.2 W to about 0.8 W, or from about 0.3 W to about 0.7 W. L4 can also range from about 0.1 W to about 0.5 W, or from about 0.2 W to about 0.45 W, or from about 0.2 W to about 0.4 W. While L5 will be approximately 0.5 W in many embodiments, it can take on other values. At one extreme, a value of about 1 W can be considered. In other embodiments, L5 can range from about 0.2 W to about 0.8 W, or from about 0.3 W to about 0.7 W, or from about 0.4 W to about 0.6 W. W itself may range from about 30 cm to about 100 cm, such as from about 40 cm to about 80 cm.

Figure 4:
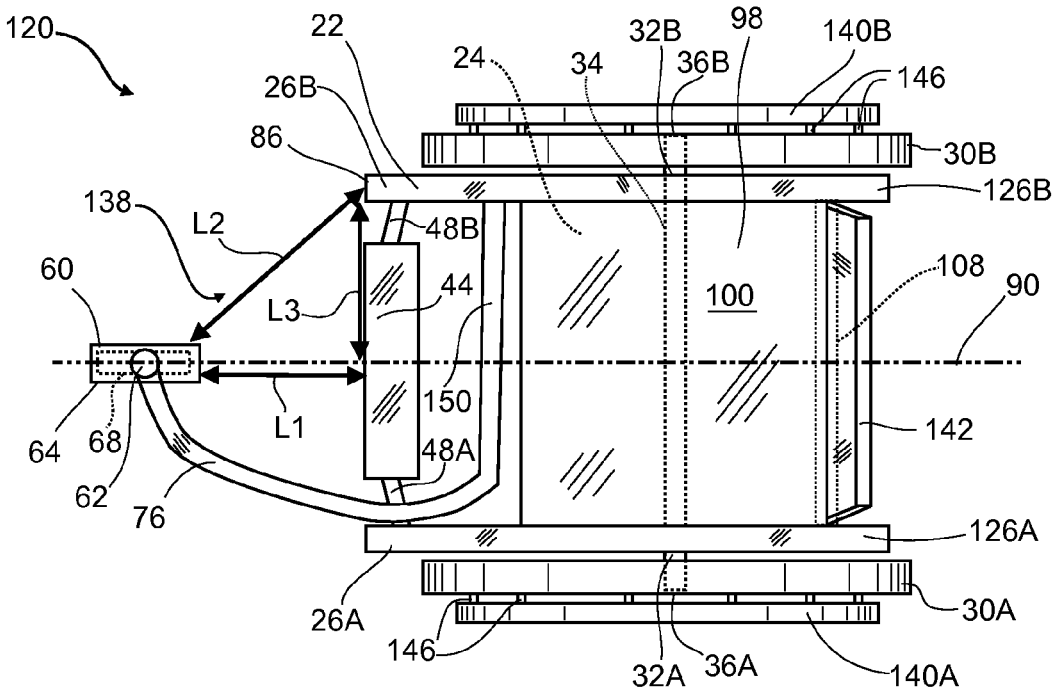
FIG. 4 depicts a wheelchair with an alternative layout for the forward wheel support.

FIG. 4 depicts a wheelchair 120 related to that of FIG. 3 but with an alternative layout for the forward wheel support 76 in which the forward wheel support 76 includes a transverse cantilever support 150 that begins at the second side 26B of the frame 22 and then extends beneath the plane of the seat 98 toward the first side 26A of the frame 22, and from that side then extends forward to support a forward wheel assembly 60 and define an asymmetric opening toward the front of the wheelchair 120. The effect, in terms of providing clearance for convenience moving in and out of the wheelchair, is similar to that for the embodiments of FIGS. 1 through 3, but depicts an alternative structure that still provides asymmetry and broad clearances. This embodiment shows that the forward wheel support 76 can extend from any of several locations on the wheelchair frame 22. In spite of the numerous possibilities for how the forward wheel support 76 is attached to the frame 22 from one or more attachment points, the forward wheel support 76 should be substantially asymmetric such that an asymmetric forward opening 138 is defined. Note that the forward wheel support 76 could also have been further attached to the first side 26A of the frame 22 as well without interfering with the asymmetry of the wheelchair 120 or without interfering with the breadth of the asymmetric forward opening 138. (In some embodiments, however, it may be desirable that forward wheel support 76 is attached to portions of only one side of the frame 22.)

Figure 5:
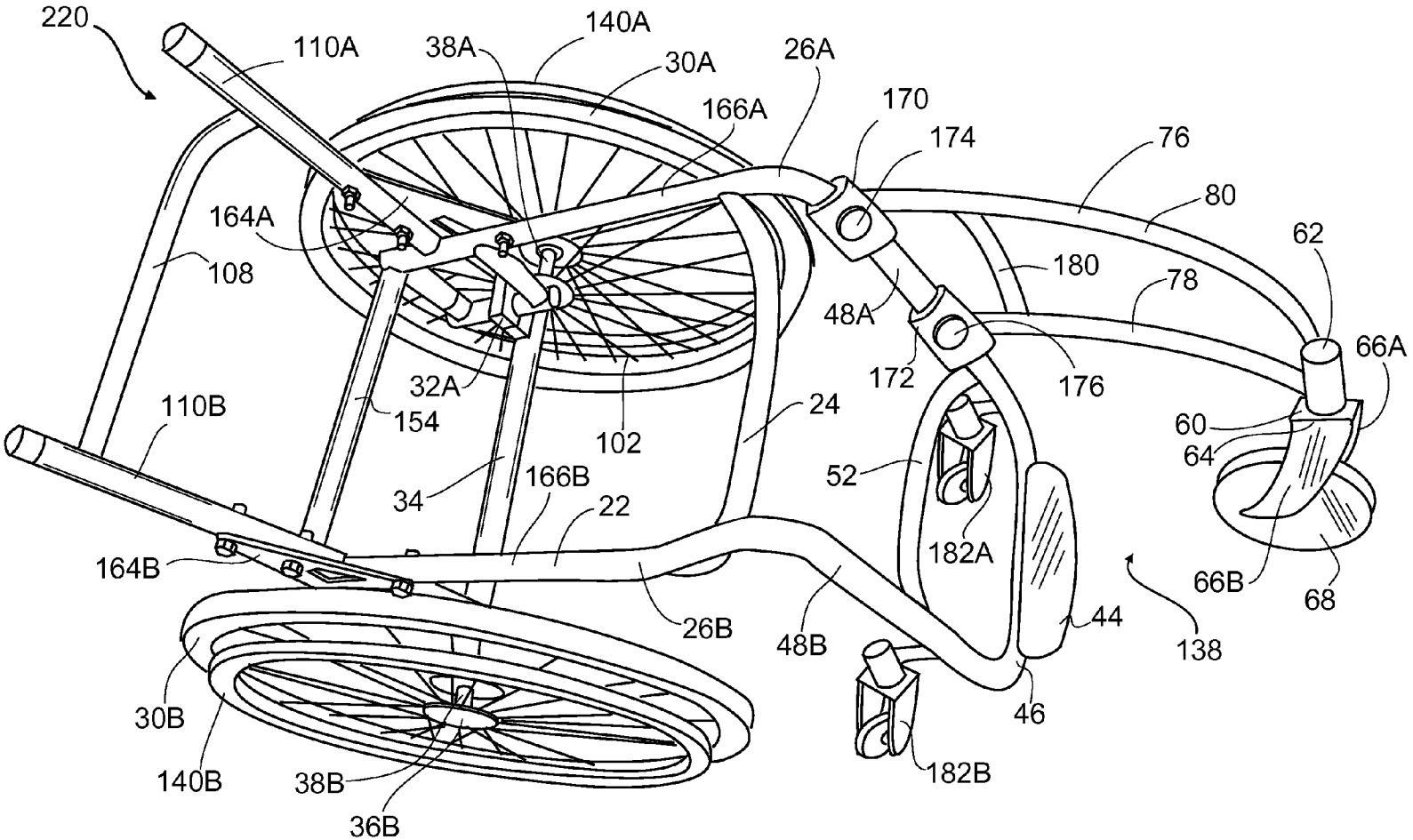
FIG. 5 depicts an asymmetric wheelchair with a removable or adjustable forward wheel support.

FIG. 5 depicts another embodiment of an asymmetric wheelchair 220 with a portion of the frame based in part upon the generally symmetric frame discussed in WO/1998/016182, published Apr. 23, 1998 by J. Roche, herein incorporated by reference to the extent that it is noncontradictory herewith. See particularly FIG. 1 of the Roche patent application. As adapted to illustrate several present embodiments, the asymmetric wheelchair 220 of FIG. 5 comprises a frame 22 with a cross member 24 and a rear connection beam 154 each connecting a first side 26A to a second side 26B. The frame 22 further comprises descending supports 48A, 48B descending respectively from the first and second sides 26A, 26B and connected to a foot support element 46 spanning the first and second sides 26A, 26B and attached to a foot rest 44. The frame 22 also supports an axle tube 34 connected to the first and second sides 26A, 26B for supporting first and second drive wheels 30A, 30B in cooperation with drive wheel assemblies 32A, 32B (not shown), respectively, that receive drive wheel axles 38A, 38B, respectively. Rising from the rear of the first and second sides 26A, 26B are first and second vertical members 110A, 110B, connected to the frame 22 via brackets 164A, 164B and joined to one another by a rear cross member 108. The vertical members 110A, 110B may further support other elements that are not shown, such as handles for pushing, a padded back support, lights, bags, control systems and electronics for motorized elements, etc.

The axle tube 34 is connected to drive wheel assemblies 32A, 32B (not shown) that rigidly hold the axle tube 34 and/or the axles 38A, 38B in place, while optionally permitting rapid release and attachment of drive wheels 30A, 30B. A wide variety of mechanisms are known in the art for releasably locking a drive wheel axle 38A, 38B in place in a wheelchair 220 or related wheeled device.

A forward wheel support 76 extends from a first side 26A of the frame 22, and in the embodiment shown is attached to the first descending support 48A with an upper adjustable attachment 170 and a lower adjustable attachment 172, each comprising releases 174, 176, respectively, which can be depressed or otherwise activated to unlock the upper and lower upper adjustable attachments 170,172, to remove the forward wheel support 76 is desired or to adjust the position thereof. The adjustable attachments 170,172 may be locking hinges, for example, or known rigid attachment and release devices such as snap-on attachments, clamps, and the like. Belts, ties, straps, and other fastening elements may also be used, as desired. Bolts (not shown) or other attachment means may be used to secure the adjustable attachments 170, 172 to the frame 22.

The forward wheel support 76 comprises an upper beam 80, a lower beam 78, and a reinforcing member 180 joining the upper beam to the lower beam 78, and is connected to the forward wheel assembly 60 comprising a caster mounting element 62 and a caster 64 with opposing forks 66A, 66B supporting a forward wheel 68.

The frame 22 is also connected to two opposing conventional casters 182A, 182B attached to the first and second sides 26A, 26B, respectively, and more specifically attached to the first and second descending supports 48A, 48B, respectively. The conventional casters 182A, 182B can serve as forward casters when the forward wheel assembly 60 is removed (i.e., by detaching the forward wheel support 76 using the adjustable attachments 170, 172. They can also function when the forward wheel assembly 60 is in place, or alternatively can be removed or may be held slightly above the surface of the ground when the forward wheel assembly 60 is in place such that they do not bear weight during use.

In the embodiment shown in FIG. 5, the asymmetric wheelchair 220 may be converted as desired to function as a substantially symmetric wheelchair with opposing conventional casters 182A, 182B or may function as an asymmetric wheelchair when the forward wheel support 76 and the forward wheel assembly 60 are in place. In one related embodiment, a conventional symmetric wheelchair may be converted to an asymmetric wheelchair 220 by attaching a forward wheel support 76 and attached forward wheel assembly 60 to the frame 22, providing the benefits of a forward wheel 68 without the barriers to access provided by symmetric supports therefor.

Figure 6:
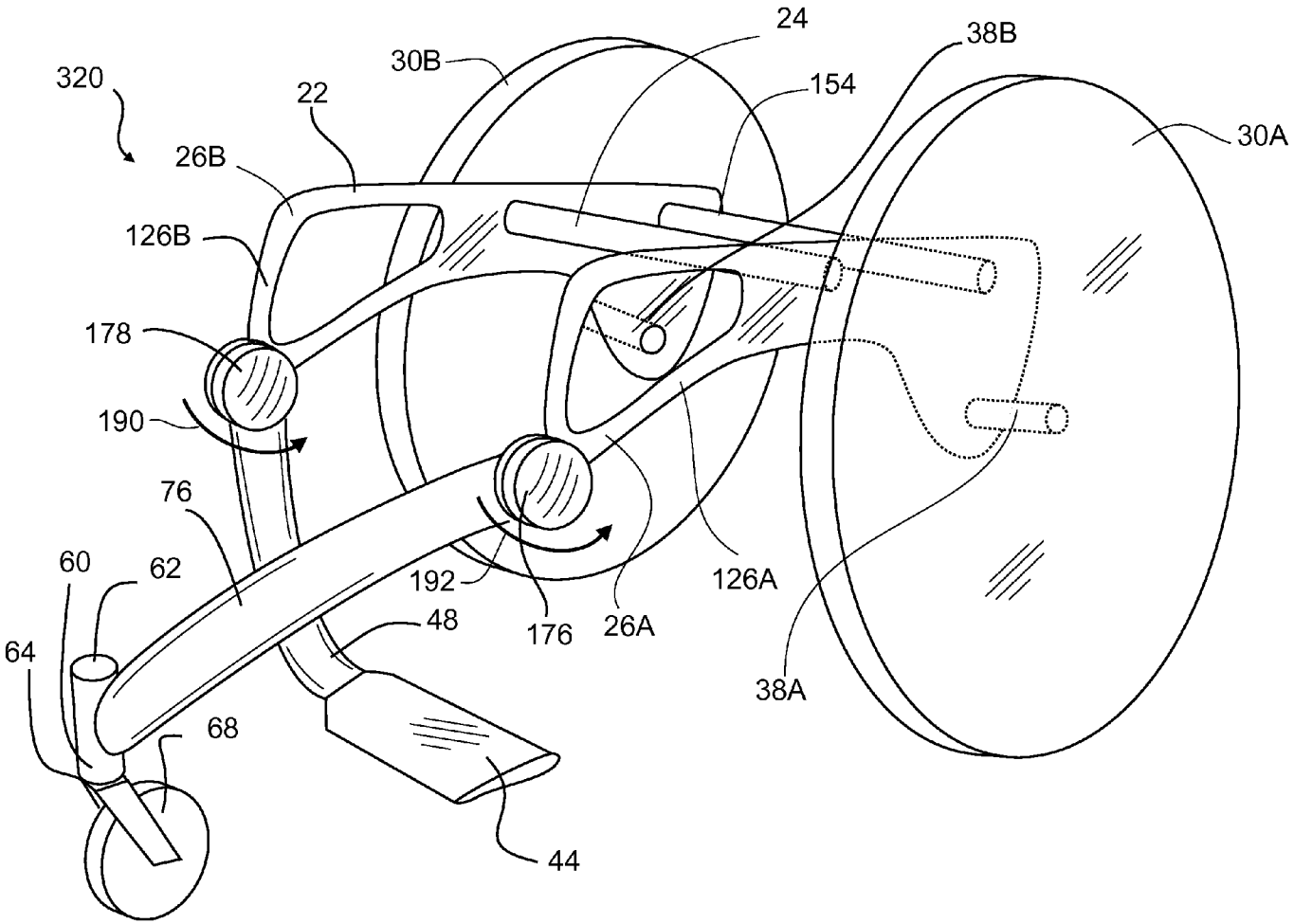
FIG. 6 depicts another embodiment of an asymmetric wheelchair.

FIG. 6 depicts an asymmetric wheelchair 320 comprising a frame 22 having first and second sides 26A, 26B comprising shaped side members 126A, 126B respectively, joined by a cross member 24 and a rear cross beam 154. A first rotating hinge 176 joins the first side member 126A to a forward wheel support 76 that holds a forward wheel assembly 60 comprising a caster 64 holding a forward wheel 68. Since there is no support means directly extending from the second side 26B of the frame 22, the wheelchair 320 is asymmetric and maintains an open area between the second shaped side member 128B and the forward wheel assembly 60. The first rotating hinge 176 that holds the forward wheel support 76 can lock into place as shown to hold the forward wheel assembly 60, or can be rotated in the direction of arrow 192 to fold the asymmetric wheelchair 320 into a more compact volume with the forward wheel assembly 60 in a collapsed position (not shown) adjacent the lower side of the cross member 24 or the lower side of the rear connection beam 154, beneath the seat (not shown).

Descending below the front portion of the second shaped side member 126B is a descending support 48 attached to a foot support 44. The descending support 48 is rotatably attached to the second shaped side member 126B by a second rotating hinge 178, which can rotate in the direction shown by arrow 190 to bring the foot support up into a collapsed position beneath the cross member 24 and the rear connection beam 154, where it can also be proximal to the forward wheel support 76 and the forward wheel assembly 60 when they are in a collapsed state also, thus allowing the asymmetric wheelchair 320 to be collapsed into a company volume for ease of transport or storage. The wheels 30A, 30B and optionally their axles 38A, 38B, respectively, can also be detached from the first and second shaped side members, 126A, 126B, respectively, for storage or transport.

Figure 7:
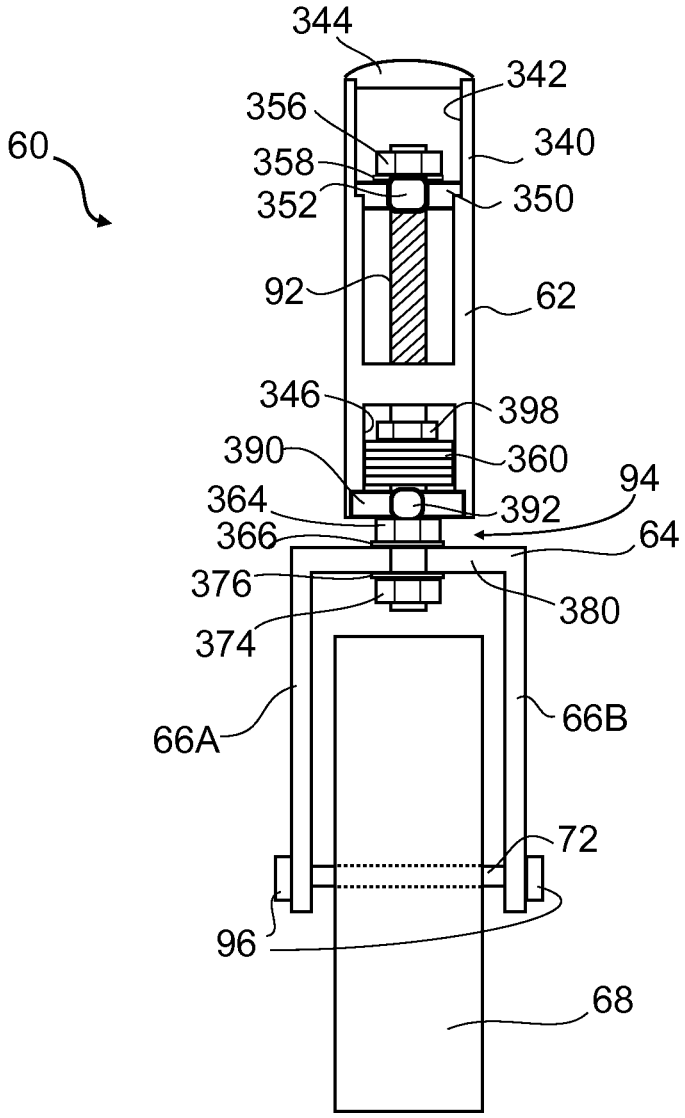
FIG. 7 depicts a mounting assembly for receiving the pivot rod of a caster for the forward wheel assembly.

FIG. 7 depicts a portion of a forward wheel assembly 60 having a caster mounting element 62 pivotably connected to a caster 64 having opposing forks 66A, 66B that receive the axle 72 of a forward wheel 68, the axle 72 being retained by locking nuts 96. The caster mounting element 62 comprises a hollow body 340 with an upper chamber 342 and a lower chamber 346, with a finely threaded pivot rod 92 within the caster mounting element 62. The pivot rod 92 is held in place in the upper chamber 342 by an upper support 350 having a ball bearing element 352 to reduce friction as the pivot rod 92 rotates. A nut 356 and washer 358 hold the pivot rod 92 in place. The upper chamber 342 is closed with a removable cap 344 at the top of the caster mounting element 62. In the lower chamber 346, the pivot rod 92 is also held in place with a lower support 390 in cooperation with a ball bearing element 392 to permit low-friction rotation of the pivot rod 92 with respect to the caster mounting element 62.

To reduce caster flutter or other instabilities, viscous damping grease (not shown) can be packed into the interior of the caster mounting element 62, particularly in the lower chamber 346. As shown in the depicted embodiment, further damping of flutter or other instabilities may be achieved by adding a stack of bushings 360 in contact with the pivot rod 92. The bushings 360 may be stainless steel, for example, or other suitable materials, and may be packed with viscous damping grease (not shown). A lower internal nut 398 holds the bushings 360 in place.

External to the body of the caster mounting element 62, a first external nut 364 and first external washer 366 receive the pivot rod 92 and help separate it from the upper body 380 of the caster 64. The pivot rod 92 is attached to the upper body 380 of the caster 64, being retained between the first external nut 366 and a second external nut 374 on the lower side of the upper body 380 of the caster 64, with a second external washer 376 between the second external nut 374 and the upper body 380 of the caster.

The embodiment shown has been tested experimentally and has been found to be useful in reducing caster flutter at elevated speeds. Other known systems can be employed to add resistance to the turning of the pivot rod 92 relative to the caster mounting element 62 to reduce the risk of caster flutter.

FIGS. 8-16 show various aspects of the present invention illustrating some embodiments in which an asymmetrical wheel chair is formed by adding an asymmetric forward wheel support to a forward portion of a wheelchair frame designed to employ two forward wheels, such as a substantially symmetric wheelchair well known in the art. "Substantially symmetric" as used herein refers to the placement of the major structural elements, particular the wheels, and indicates that wheelchair was designed for use with opposing right and left front wheel and typically opposing right and left rear wheels, with the left and right sides largely being mirror images of one another about a longitudinal central vertical plane of the wheelchair. The addition of design features or other minor elements that add some degree of asymmetry to the wheelchair generally do not obviate the fact that the basic structure of the frame of typical wheelchairs in the art is substantially symmetric.

Figure 8:
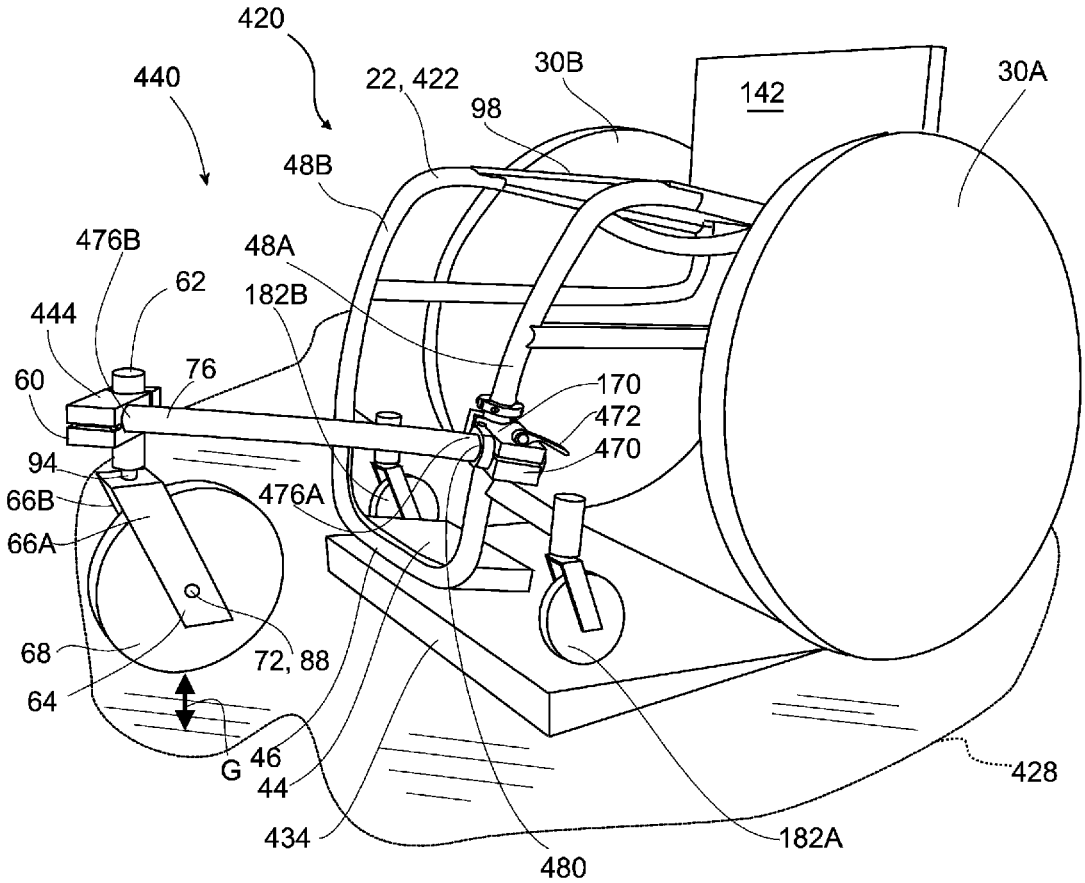
FIG. 8 depicts a perspective view of an embodiment of the asymmetric wheelchair with a removable forward wheel support attached to the frame of an existing symmetrical wheelchair.

FIG. 8 depicts a perspective view of an embodiment of the asymmetric wheelchair 420 comprising a symmetrical wheelchair frame 22 designated as the "primary frame" 422 to denote the frame structure before the asymmetric elements of the present invention are added. Attached to the primary frame 422 is an added removable forward wheel support 76 having a first end portion 476A joined to a descending support 48A (a substantially vertical frame member of the primary frame 422) on a first side 26A with an adjustable attachment 170 comprising a first mounting member 470 and a quick-release clamp 472. As in many conventional wheelchairs, the descending support 48A may comprise an inward bend or taper such that suitable attachment portions of the descending support 48A are not perfectly aligned with a vertical longitudinal plane. Thus, in order to ensure proper performance of the caster 64, angular adjustment may be necessary for vertical alignment of the forward wheel assembly, with respect to its orientation about the longitudinal axis of the wheelchair. The axle for the opposing rear wheels 30A, 30B is not shown. Opposing front conventional casters 182A, 182B (e.g., the forward wheels of typical wheelchairs known in the art) are attached to descending supports 48A, 48B of the primary frame 422. (The term "conventional casters" as used in this context refers to opposing symmetric casters such as the forward wheels of conventional wheelchairs, and should not be understood to exclude any suitable known wheels that could be used in combination with the asymmetric elements of the invention as claimed.)

The forward wheel assembly 60 comprises a caster 64 with opposing forks 66A, 66B holding a wheel 68, an axle 72, a hub 88. The opposing forks 66A, 66B are attached to a pivot rod 94 which can pivot in a caster mounting element 62. In this embodiment, the caster 64 is attached to a second end portion 476B of the forward wheel support 76 with a caster mounting block 444 that receives both the caster mounting element 62 of the caster 64 and the forward wheel support 76. The mounting block 444 may be adjustable and may comprise quick release clamps (not shown), set screws, or other means for adjustably securing the caster 64 to the forward wheel support 76.

In this embodiment, the forward edge of the foot rest 44 and the foot support element 46 are substantially remote from the forward wheel 68, with a space therebetween that can be, for example, at least 20 cm or at least 30 cm. In general, in related embodiments, the foot rest 44 is connected to the primary frame 422 and not directly connected to the forward wheel assembly 60. In alternate embodiments (not shown), if desired, the foot rest 44 may be attached to the forward wheel assembly 60. However, when it is connected to the primary frame 422 as shown, the gap between it and the forward wheel 68 can, in some embodiments, provide improved ease of moving in and out of the wheelchair 420.

In the embodiment shown, the asymmetric wheelchair 420 has been rolled onto an optional short ramp 434 that elevates the conventional casters 182A, 182B of the primary frame 422 relative to the drive wheels 30A, 30B such that the wheel 68 of the forward wheel assembly 60 will be elevated above the ground 428 when attached, leaving a gap G above the ground 428. When the primary frame 422 is positioned on the short ramp 434 as shown, the forward wheel assembly 60 can be attached or detached from the primary frame 422 while only the conventional casters 182A, 182B and the drive wheels 30A, 30B bear any load, making it more convenient to attach, detach, and adjust the forward wheel support 76 and the forward wheel assembly 60.

In this and in several other embodiments, this forward wheel support 76 is curved but when properly positioned, remains substantially parallel to the ground across its length.

Figure 9A:
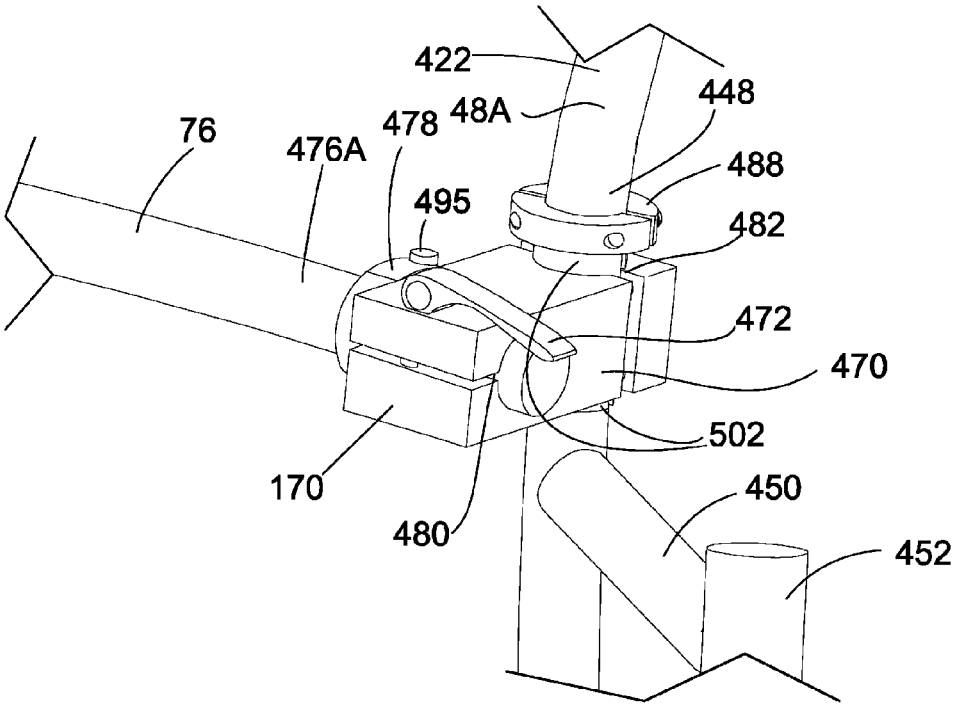
FIGS. 9A and 9B display details of the connection joining the forward wheel support and the frame of an existing symmetrical wheelchair.
Figure 9B:
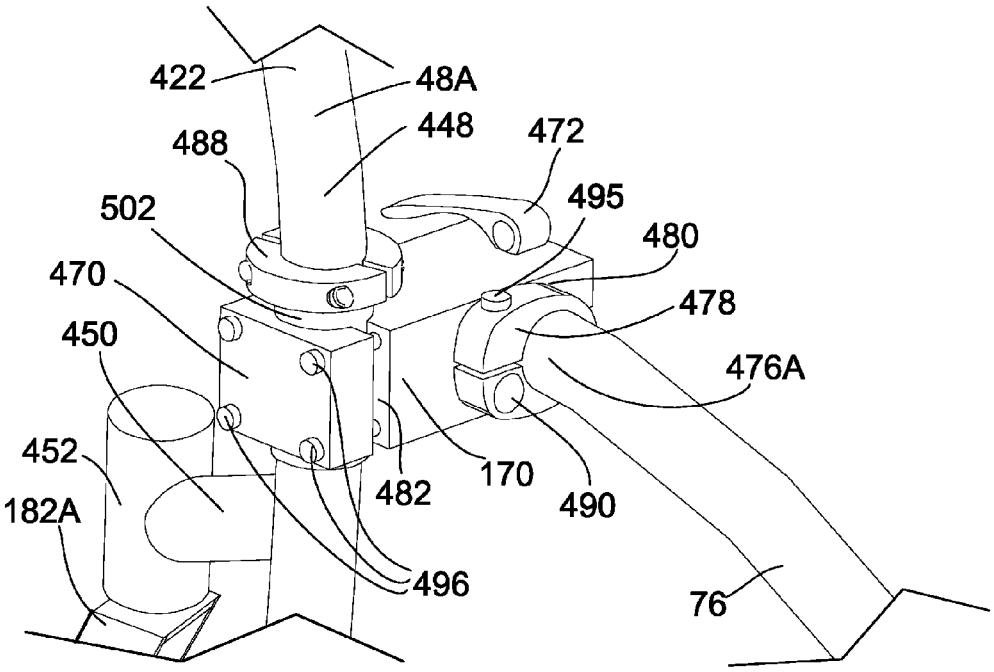

FIGS. 9A and 9B show two perspective views of the adjustable attachment 170 of FIG. 8 that connects the forward wheel support 76 to the primary frame 422, and in particular to a descending support 48A of the primary frame 422. The adjustable attachment 170 in this embodiment comprises a first mounting member 470 that can be permanently or removably attached to the primary frame 422 (e.g., it may be welded on or bolted on). The first mounting member 470 has a first opening 480 for receiving a first end portion 476A (e.g., a tubular end portion) of the forward wheel support 76. A first ring 478 (e.g., an indexing collar) is attached to the first end portion 476A for engaging with the first mounting member 470 in a predetermined manner. Visible is collar bolt 495 providing clamping pressure to securely constrict the first ring 478 around the first end portion 476A. Loosening collar bolt 495 releases clamping pressure around the first ring, allowing the first ring 478 to be rotated around the first end portion 476A of the forward wheel support 76. The first end portion 476A is firmly secured in the first mounting member 470 with the aid of clamping pressure provided by the quick-release clamp 472.

The first mounting member 470 comprises a second receptacle 482 for receiving a portion of the primary frame 422, in this case a tubular member 448 of the descending support 48A. Visible in FIG. 9B are bolts 496 providing clamping pressure to securely restrain the first mounting member 470 on the primary frame 422, though it is understand that other removable or permanent means (not shown) may be used, including welding, the use of quick release clamps, screws, etc. A second ring 488 (e.g., an indexing collar) on the tubular member 448 of the primary frame 422 may be used to assist in setting the position of the first mounting member 470 and/or in securing the first mounting member 470 to the primary frame 422. An optional gripping element 502 such as a rubber sleeve or other high friction material may be used between the tubular member 448 of the descending support 48A and the first mounting member 470 (or may be integral with either) to reduce the risk of slipping of the first mounting member 470 relative to the tubular member 448.

Also shown below the first mounting member 470 in these perspectives are the support beam 450 for the conventional caster 182A, whose wheelchair caster mounting member 452 is joined to the support beam 450. Other known configurations for conventional casters attached to a primary frame 422 may be used.

Figure 10:
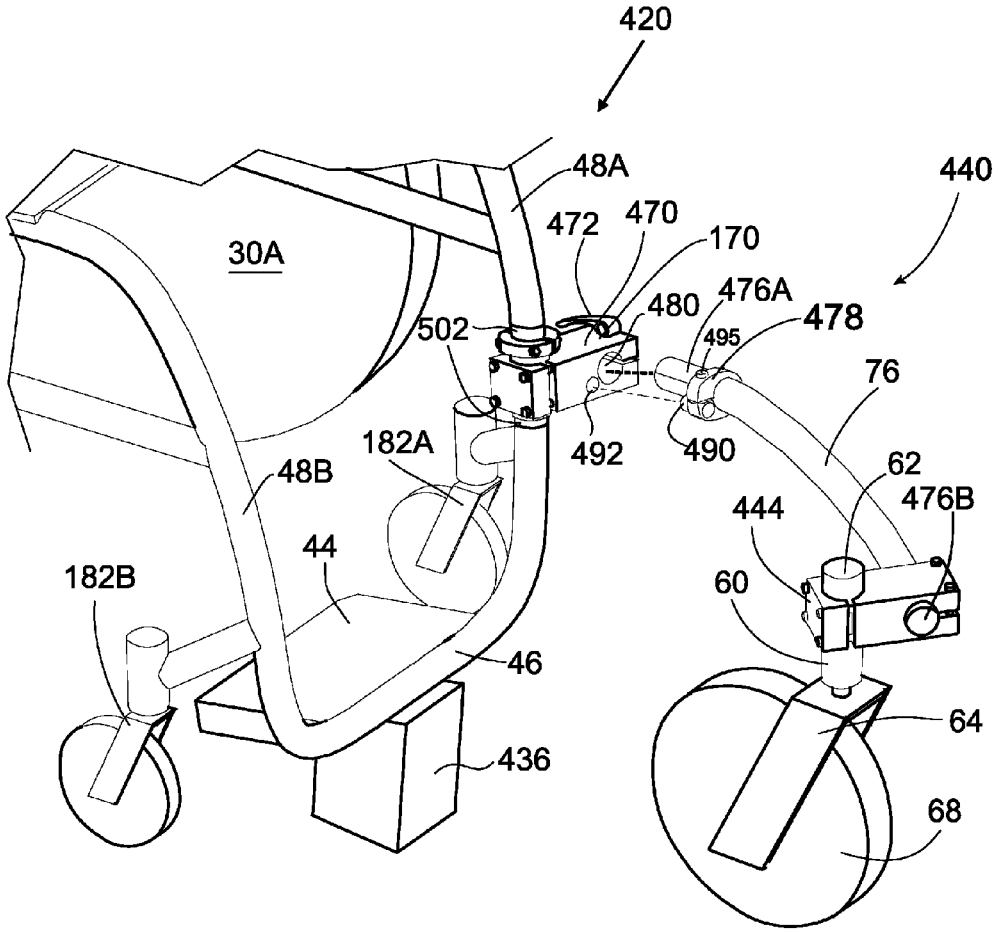
FIG. 10 displays a portion of an embodiment of the asymmetric wheelchair of the present invention.

In FIG. 10, conversion of a wheelchair is performed by attachment or detachment of the releasable wheel assembly 440 having forward wheel support 76 having a first end portion 476A. A portion of the wheelchair 420 is shown in perspective view with the forward wheel support 76 detached from the adjustable attachment 170 to show how the first end portion 476A (here a tubular end portion) of the forward wheel support 76 engages with the first receptacle 480 of the first mounting member 470. A second opening, the pin receptacle 492, in the first mounting member 470 is adapted to receive an indexing pin 490 projecting from the first ring 478 secured to the forward wheel support 76. The indexing pin 490, when engaged within the pin receptacle 492, prevents the tubular first end portion 476A of the forward wheel support 76 from rotating within the first receptacle 480, thus securing the forward wheel support in an orientation relative to the wheelchair, and furthermore securing the caster with respect to its rotational orientation about a longitudinal axis of the wheelchair. Loosening of collar bolt 495, which allows the first ring 478 to be rotated around the first end portion 476A of the forward wheel support 76 enables adjustment of the caster orientation. The caster orientation relative to the wheelchair can, once again, be secured by tightening collar bolt 495. Other means (not shown) can be used to prevent unwanted rotation of the forward wheel support 76, including set screws, the use of non-circular engaging elements (e.g., the first end portion 476A could have a square or other non-circular cross-section corresponding to a similar non-circular cross-section of the first receptacle 480), etc. In one version, an optional gripping element 502 comprising elastomeric material or other high friction material may be present between the contacting surfaces to provide enhanced grip. For example, the gripping element 502 may be a rubber sleeve placed around a portion of the frame 22 that engages the adjustable attachment 170.

Also shown in FIG. 10 is an optional support block 436 which could be used to elevate the forward portion of the wheelchair 420 to allow the forward wheel assembly 60 to be installed or adjusted in position without bearing load during the process. After removal of the block, the forward wheel 68 of the forward wheel assembly 60 would bear the forward load of the wheelchair 420, and the conventional casters 182A, 182B could be elevated and no-longer load bearing or could also be load bearing, if desired. The caster mounting block 444 shown in this embodiment secures the caster 64 of the forward wheel assembly 60 to the forward wheel support 76. It may use mechanisms similar to those of the first mounting member 470, including bolts and/or quick release clamps (not shown) if desired.

Figure 11:
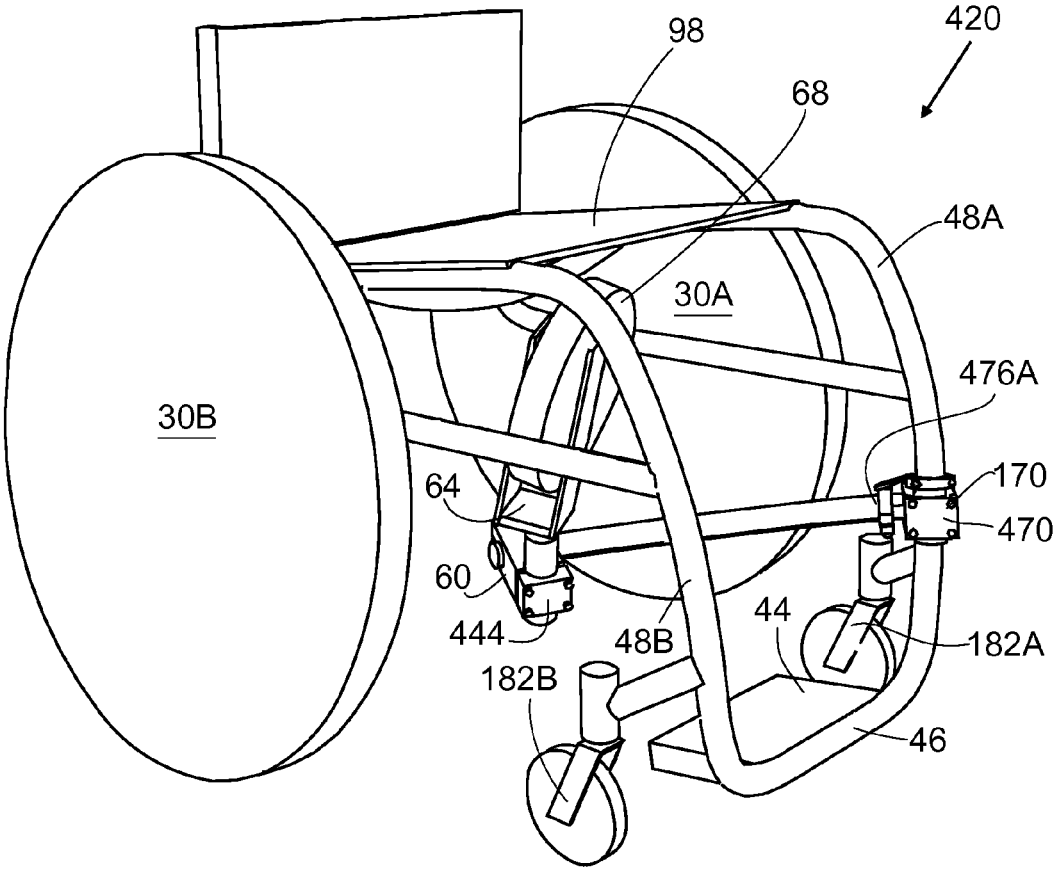
FIG. 11 shows a perspective view of an embodiment of the asymmetric wheelchair of the present invention in which the forward wheel assembly can be held under the seat of the wheelchair when not in use.

FIG. 11 shows the asymmetric wheelchair 420 with the forward wheel assembly 60 in a stowed position under the seat 98. To reach this configuration, the forward wheel support 76 was detached from the first mounting member 470 and the first end portion 476A thereof was reconnected to the back side of the first receptacle 480 of FIGS. 9A, 9B, and 10. The first mounting member 470 may need to be rotated relative to the descending support 48A of the primary frame 422.

Figure 12:
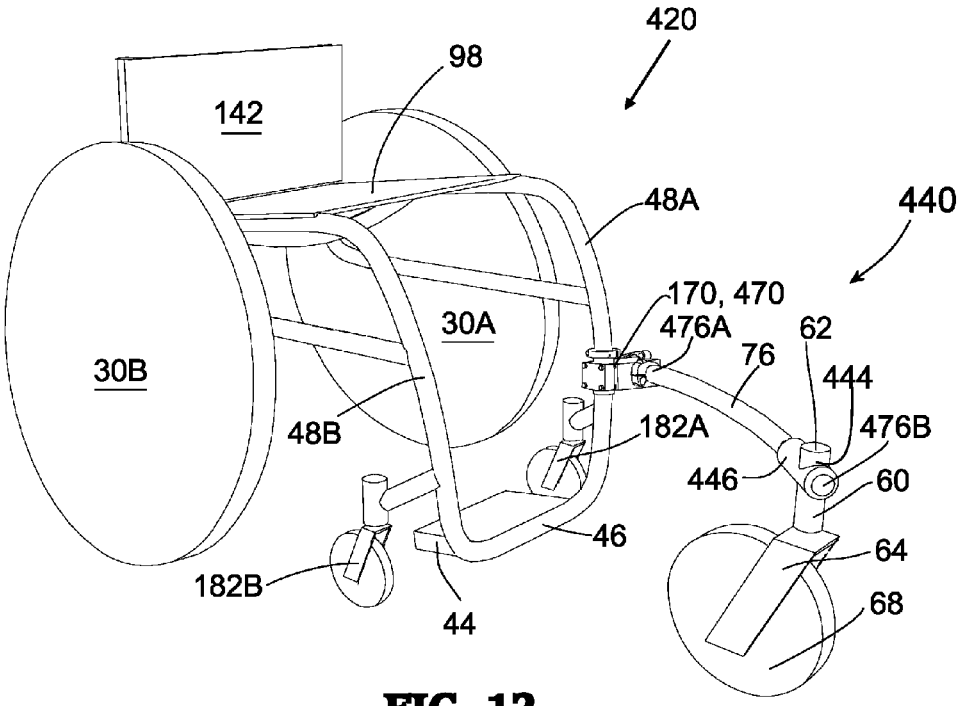
FIG. 12 shows another embodiment of the asymmetric wheelchair.

FIG. 12 shows an asymmetric wheelchair 420 similar to that of FIG. 8 but with an alternative construction of the caster mounting block 444 in which a receiving element 446 is directly attached to the caster mounting element 62 of the forward wheel assembly 60. The receiving element 446, here depicted in the form of an open cylinder, receives the second end portion 476B of the forward wheel support 76. The second end portion 476B of the forward wheel support 76 may be further secured and/or made adjustable by various means (not shown) cooperating with or integral to the receiving element 446 such as set screws, clamps, indexing pins, and the like, thus rotationally securing the caster, adjustably, in an orientation relative to the wheelchair.

Figure 13:
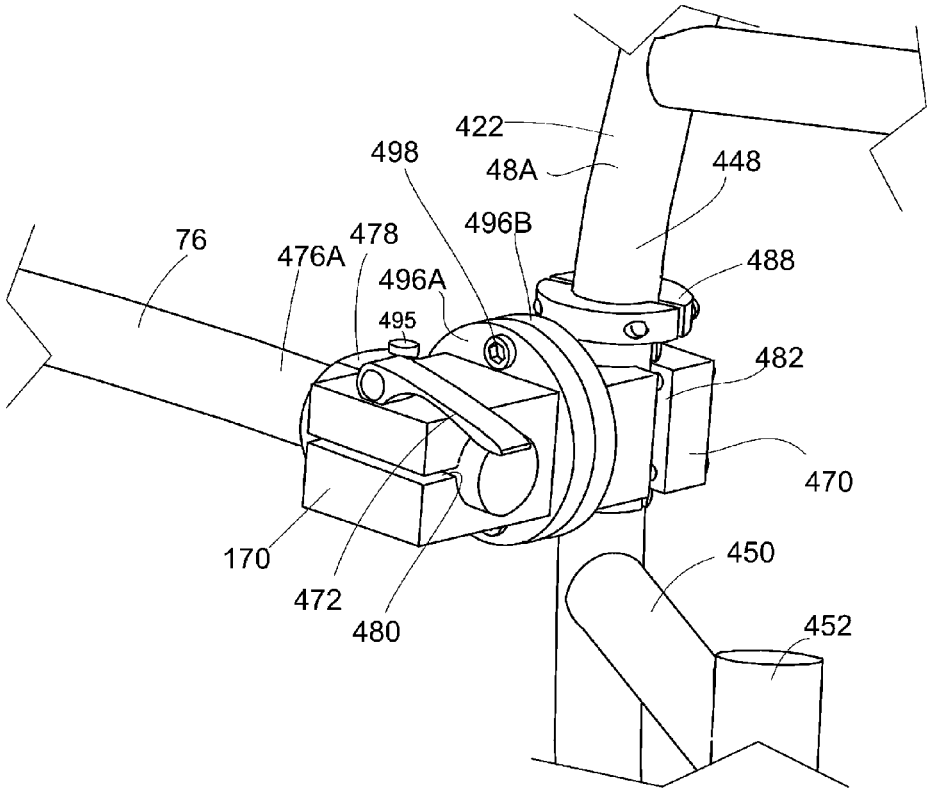
FIG. 13 shows details of one embodiment of a mounting member connecting the primary frame of a wheelchair to a forward wheel support.

FIG. 13 shows an alternate configuration for the adjustable attachment 170 similar to that of FIGS. 9A and 9B but in which the first mounting member 470 further comprises two opposing mounting plates 496A, 496B that are adjustably secured in desired orientations with bolts 498 or other known attachment means. In this manner the orientation of the forward wheel support 76 relative to the frame can be adjusted to raise or lower the forward wheel 68 (not shown) as desired. It is to be understood that many other details for attachment, adjustment, release, and other operations of the adjustable attachment 170 may be made without departing from the scope of the invention as claimed, and that additional attachment arms and attachment assemblies may be present, as desired, also without departing from the scope of the invention as claimed.

Figure 14:
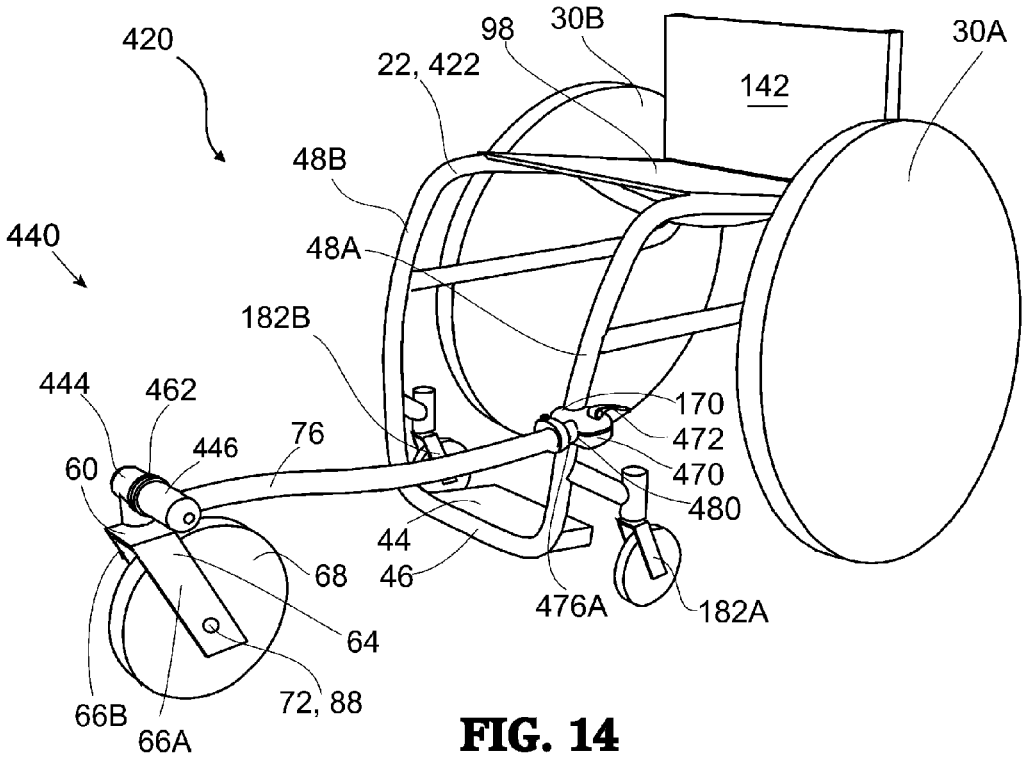
FIG. 14 is a perspective view of yet another embodiment of an asymmetric wheelchair of the present invention.

FIG. 14 shows another embodiment of the asymmetric wheelchair 420 similar to that of FIG. 8 but in which alternate configurations are shown for the adjustable attachment 170 and the caster mounting block 444. The caster mounting block 444 has a receiving element 446 for receiving the forward wheel support 76. A rotatable locking element 462 allows the position of the receiving element 446 and the forward wheel support 76 to be adjusted relative to the caster 64 about a lateral axis passing through the center of the rotatable locking element. In the adjustable attachment 170 attached to the frame 22, the first mounting member 470 as shown receives a non-circular first end portion 476A of the forward wheel support 76 that engages with a mating receptacle 480 of the first mounting member 470.

FURTHER DETAILED DESCRIPTION

The use of a primary frame from a conventional or substantially symmetric wheelchair with an attachable forward wheel support to provide an asymmetric wheelchair of the present invention may support a variety of benefits, though not all benefits need to be achieved to still be within the scope of the invention as claimed. In some embodiments, the attachable forward support can be adapted for easy storage under the chair of the wheelchair or elsewhere on or adjacent the wheelchair (e.g., in a bag) to make it easy to convert from a substantially symmetric wheelchair to an asymmetric wheelchair when desired. In some embodiments, the forward wheel assembly added to the primary frame can be readily positioned at a desired height or at a desired position lateral position relative to the central vertical longitudinal plane of the wheelchair. In this manner, the forward wheel assembly may be disposed substantially centrally or may be to the right or to the left of the central vertical longitudinal plane of the wheelchair, as desired. In one embodiment, the relative position of the forward wheel assembly can be readily adjusted by the user by the manual application of torque to the forward wheel assembly to cause rotation within the adjustable attachment relative to the axis of the member of the primary frame that the forward wheel support us attached to. Adjustment of the relative position of the forward wheel support can provide for increased clearance, when desired, for transfers or other actions with the wheelchair.

In some embodiments, the amount of bend in the tubular arm can be at least equal to (or 10 or more degrees greater than) the deviation of the wheelchair's "front frame angle" (as conventionally referred to by wheelchair manufacturers) from 90 degrees with the ground. Thus, if the front approximately vertical frame members of a primary frame are at an angle of, say, 80 degrees instead of 90 degrees relative to the plane of the ground, then the forward wheel support may have an arm with a curvature of about 10 degrees or greater, such as about 15-25 degrees or about 20 degrees. More generally, the forward wheel support may have a bend corresponding to the deviation of the wheelchair's "front frame angle" from 90 degrees with the ground plus or minus 5 degrees, or plus from zero to about 10 degrees. A bent or curved forward wheel support may thus serve as a positioning element, used to provide sufficient angular compensation against the deviation of the front frame angle of the wheelchair from 90 degrees, to secure the caster in a substantially vertical orientation.

If a perfectly straight tubular arm were desired instead, then the angular compensation could be achieved by changing the angle of either the first mounting member or the caster mounting element. This could be accomplished by having a first mounting member or caster cylinder block that is adjustable over a range of useful angles or it could be accomplished by having a custom "fit kit" consisting of a first mounting member or caster cylinder block machined to a custom angle specific to the user's wheelchair. The first mounting member or the caster cylinder block may thus serve as positioning elements, used to provide sufficient angular compensation against the deviation of the front frame angle of the wheelchair from 90 degrees, to secure the caster in a substantially vertical orientation.

The forward wheel assembly may have a built-in angle adjustment, in case the user changes to different sized wheels, which would alter the angle of the entire wheelchair and therefore the angle of the caster cylinder. A set screw or bolt can be loosened to allow the angle to be adjusted in 1 degree increments.

In attachable/detachable versions of the asymmetric wheelchair, one can suitably position the caster cylinder, if desired, so that it is substantially vertical to resist rotation and assist in proper forward tracking. Adjustable components in the attachment mechanisms can assist in such positioning. If the front frame angle of the wheelchair is perfectly vertical, then no angular adjustments may be needed to compensate for front frame angle. However, many wheelchairs have at least 5 degrees of deviation from the vertical. To compensate for this, as previously described, it may be useful to adjust the angle using positioning elements: the adjustable attachment that attaches the forward wheel support to the wheelchair frame, the caster mounting block that attaches the forward wheel support to the caster, the forward wheel support itself, or a combination thereof.

The wheelchair may comprise cambered wheels and adjustable foot supports such as those disclosed in U.S. Pat. No. 5,480,172, "Three-Wheeled Competition Wheelchair Having an Adjustable Center of Mass," issued Jan. 2, 1996 to D. W. James, herein incorporated by reference to the extent that it is noncontradictory herewith.

As disclosed in U.S. Pat. No. 5,320,373, "Molded-Composite Chassis for a Wheelchair," issued Jun. 14, 1994 to S. A. Robertson et al., herein incorporated by reference to the extent that it is noncontradictory herewith, the seat in various embodiments can be operably associated with means for adjusting the longitudinal position of the seat relative to the sides of the frame so that the seat can be located at one of a plurality of different longitudinally disposed locations relative to the sides of the frame. It may also be operable associated with means for adjusting the height and the angle of the seat relative to the frame.

Caster wheels can be subject to rapid vibration and instability at high velocity, a phenomenon sometimes called caster flutter or caster shimmy. Any known remedy may be implemented, if desired, to increase stability at elevated speed. Such remedies include dampening mechanisms such as chambers containing viscous fluid in contact with a portion of a rotating rod that turns with the caster. Solutions can include the viscous damping technologies of U.S. Pat. No. 4,432,116, "Damper Including a Viscous Damping Medium," issued Feb. 21, 1984 to J. C. Schultz; U.S. Pat. No. 7,284,299, "Caster," issued Oct. 23, 2007 to Ruckman et al.; and U.S. Pat. No. 4,097,954, "Flutter-Resistant Caster," issued Jul. 4, 1978 to C. O. Christensen. In the Christensen patent, U.S. Pat. No. 4,097,954, resilient elements impose a pre-load upon bearing means to impede fluttering of said caster.

Regarding the drive wheel assembly for connecting the drive wheels to the frame, any known system can be used such as those disclosed in U.S. Pat. No. 5,409,247, "Wheelchair Frame," issued Apr. 25, 1995 to S. A. Robertson and R. Geiger, herein incorporated by reference to the extent that it is noncontradictory herewith. U.S. Pat. No. 5,409,247 describes a wheelchair frame comprising a pair of side frame assemblies, each of which includes a bottom member and a seat mounting member that are connected to one another, each bottom member having a flat upwardly facing surface at a rear region of the bottom member; a generally U-shaped mounting block mounted on each bottom member at the rear region of the bottom member, each mounting block being open upwardly and having an upwardly facing end surface; drive axle receiving means mounted on each mounting block for receiving a drive wheel axle, each drive wheel axle receiving means including a mounting plate portion and an axle receiving portion, said mounting plate portion and said axle receiving portion being integral and formed in one piece, said mounting plate being positioned on the end surface of a respective mounting block and resting on the upwardly facing flat surface at the rear region of the bottom member; connection means for removably connecting said drive axle receiving means to a respective mounting block to allow the drive axle receiving means to be disconnected from the respective mounting block so that the drive axle receiving means and the mounting blocks can be moved longitudinally along the rear region of the bottom member; and support means for rigidly connecting said side frame assemblies to one another, said support means including a cross-bar connected to each mounting block and extending between the side frame assemblies. The cross-bar of U.S. Pat. No. 5,409,247 may correspond to the axle tube described in some embodiments herein.

Braking systems can also be incorporated, as desired, such as those of U.S. Pat. No. 6,443,268, "Braking System for a Wheelchair," issued Sep. 3, 2002 to W. Dearth et al. Hand brakes, electronic brakes, gears, and the like may be used.

Rear anti-tip devices may be used that permit wheelie-like functioning. Power-assisted mechanisms of any suitable kind may be incorporated.

EXAMPLES

Example 1

A wheelchair according to the design generally shown in FIG. 1 was constructed from aluminum tubing using commercial components for wheels, seats, etc., substantially as shown in FIG. 1. Tubular aluminum components were welded together for the structural elements of the frame. A high-viscosity (60,000 cSt) damping fluid was incorporated in the caster to prevent flutter or "shimmy" at elevated speeds. Little if any caster flutter has been observed with the high-viscosity damping fluid in place.

The forward wheel support was formed from aluminum tubes that were prepared by roll forming. Two beams were independently roll formed to impart curvature that would become vertical curvature in the final wheelchair (beginning from a high elevation at the connection to the frame and descending to the forward wheel assembly). Then the curved beams were welded together, being connected by a vertical cross member and joined to a support member for attachment to the caster. After being welded together, the beams were then roll formed again and thereby given curvature orthogonal to the curvature previously received, such that in the final wheelchair, the second application of curvature would result in curvature inward from the first side of the frame toward the central longitudinal axis of the wheelchair to place the forward wheel assembly in a substantially central location for good performance.

The wheelchair was tested by a male paraplegic having a "T-6 complete" spinal cord injury. This means that the user has no motor or sensory function below the 6th thoracic vertebra, which in other words means he has no voluntary control of the muscles in his legs and the lower half of his torso. The act of transferring from one seating surface to another (such as from a wheelchair to another wheelchair or from a wheelchair into an automobile) therefore depends on the active use of his upper body and the learned control of the lower body through positioning techniques, as taught the user by a licensed physical therapist. For example, he has learned precisely where to place his feet (using arms and hands) relative to the surface he is transferring into. He has also learned to control the involuntary spasticity that occurs in his legs (again, using his arms and hands) so that he can transfer safely. The user describes his experience with the asymmetric wheelchair during experimental use as follows:

Learning how to transfer into and out of the prototype "Asymmetric all-terrain wheelchair" was very easy, as performing this transfer was not significantly different compared to transfers into and out of my conventional "everyday" wheelchair (an Invacare A-4 style or "Terminator Titanium" wheelchair).

During the period that I have tested out the prototype wheelchair, I have most frequently performed transfers to and from my everyday wheelchair on a smooth, level concrete surface in my garage. These transfers have been very easy to perform, especially because the two wheelchair seats have nearly identical elevations and also because it is very easy for me to position my feet and legs into the space between the footrest and the forward wheel of the asymmetric wheelchair.

I have also transferred to and from automobiles on a regular basis, although not as frequently as the previously mentioned "chair-to-chair" transfers. Typically, I have transferred into and out of the drivers' seat of our Nissan Quest minivan, which has a seat at an elevation approximately 8 inches above the level of the seat of the asymmetric wheelchair. Since I have an unobstructed opening on the right side of the wheelchair, this transfer is also relatively easy to perform. This transfer is somewhat more difficult to perform to and from the passenger side of the minivan, since it requires me to lift my legs over the forward structural elements of the wheelchair. I have also performed numerous driver-side transfers into and out of my Mitsubishi Eclipse 2-door coupe with relative ease, including removal of the quick-release wheels and storing the entire wheelchair frame in the back seat area.

Transfers to and from the ground are considerably more complicated, but I have performed them completely unassisted without any significantly different technique compared to the way in which I transfer to and from the ground using my conventional "everyday" wheelchair.

Other surfaces to which I have transferred include: sofas, park benches, kitchen chairs, and the toilet.

I have used this wheelchair to traverse/negotiate various types of concrete and asphalt pavement (smooth, irregular, weathered/cracked), long and short grasses, wood chips, forest terrain, standing water, ice, slush, snow, and uphill and downhill surfaces.

Due to its length, the prototype has moderately decreased maneuverability indoors, such as in tight bathroom spaces and in restaurants. However, its length gives it excellent forward stability, especially for the purpose of traversing irregular outdoor terrain. The prototype has demonstrated excellent agility and maneuverability for such activities as performing yard maintenance (weeding, trimming shrubs, watering trees) and supervising children at play.

The prototype has performed with a high degree of reliability at a wide range of speeds. The wheelchair is an excellent companion to the "Wijit" lever drive system by Superquad, especially on pavement and gravel. The wheelchair has performed very well with a range of different tire treads designed for street use and trails.

The aluminum frame has remained strong with no broken joints and has exhibited no unwanted flexibility or movement of one side relative to the other.

While seated in the prototype wheelchair, my posture is firmly upright and I am seated securely and comfortably. The wheelchair is not tiresome to sit in or operate for prolonged periods of outdoor activity. While in forward motion, I am able to direct my attention forward and several hundred feet ahead, rather than solely attend to the surface immediately in front of me.

The wheelchair is lightweight and does not present a significant increase in rolling resistance compared to my everyday wheelchair.

I have never fallen out of this wheelchair.

Depending on the physical health and condition of the user, transfer in and out of the wheelchair may be done without assistance. In making a transfer without assistance, a user, for example, may be seated in a chair adjacent to the wheelchair. The user may place his or her feet on the ground between the front of the second side of the wheelchair and the forward wheel assembly and then using both the frame of the wheelchair and the edge of the chair for support, transfer weight to the arms as the body is swung through the clearance and into the seat of the wheelchair in a simple motion.

Example 2

An existing four-wheeled substantially symmetrical wheelchair was modified by removably attaching a forward wheel support generally following the system shown in FIGS. 8-10.

The primary frame of the wheelchair used in this example has a front frame angle of 85 degrees. To provide proper orientation of the forward wheel assembly from a forward wheel support attached to the front of the primary frame, the tubular arm of the forward wheel support was given slightly over 5 degrees of effective bend (one end relative to the other end). This allows for sufficient adjustability of the angle of the caster cylinder (which generally should be at 90 degrees with the ground) by using the bend to compensate for the wheelchair's front frame angle.

Further, a ⅛" thick rubber sleeve was placed over the front frame tube of the wheelchair, and then secured the frame clamp of the first mounting member around the rubber sleeve. This affixes the assembly to the wheelchair frame with sufficient stiffness to prevent it from rotating around the front frame tube of the wheelchair. Yet with enough force, it allows the user to swing the assembly inward or outward relative to the wheelchair's center line. This rubber sleeve also provides some degree of shock absorption.

To further improve the stability of the forward wheel support, an indexing system was created which consists of an indexing collar, indexing pin, and indexing socket. The purpose of this indexing system is so that the tubular arm and caster assembly can be attached and detached by simply tightening or loosening the quick-release lever on the arm clamp of the first mounting member and sliding the tubular arm into or out of the main socket of the first mounting member, without any need for further adjustment. Also, this reduces the amount of pressure required by the quick-release lever/clamp mechanism because all rotational torque of the tubular arm is prevented by the articulation of the indexing pin within the indexing socket, provided the indexing collar is sufficiently tight around the tubular arm. So, this indexing system satisfies the requirement for proper alignment of the caster cylinder in the attachable/detachable embodiment of the "asymmetric open-access wheelchair" invention.

For the purpose of stowing the assembly under the wheelchair (below the seat and behind the footrest), the rear side of the first mounting member also accepts the tubular arm, and the quick-release clamp(s) hold it in place.

A split shaft-collar can be attached directly above and in contact with the first mounting member and rubber sleeve to prevent sliding or traveling axially up the front tube of the wheelchair frame. Without this split shaft-collar, this axial sliding might occur after several repetitions of moving the assembly inward or outward about the axis of the front tube of the wheelchair frame.

During attaching/detaching, the front end of the wheelchair should be suitably elevated. In the case of attaching the assembly, sufficient elevation of the front end of the wheelchair provides the clearance necessary to be able to fully insert the tubular arm and indexing pin into their respective sockets. Once attached and securely clamped, the user can then lower the front end of the wheelchair onto the ground; all weight that was previously placed on the wheelchair's existing casters will now be placed on the caster wheel of the asymmetric attachment. In the case of detaching the assembly, sufficient elevation of the front end of the wheelchair relieves the weight placed on the caster wheel of the asymmetric attachment and provides the clearance necessary to be able to slide the tubular arm and indexing pin out of their respective sockets. Once removed, the user can then lower the front end of the wheelchair onto the ground so the wheelchair's existing caster wheels bear their normal weight. This process is accomplished with a platform of sufficient height and strength (e.g., a ramp, a wooden block, a molded jack stand, or a leveraged "kickstand" device) which temporarily bears the weight of the front end of the wheelchair during the attaching/detaching process.

Remarks

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above compositions, products, and methods without departing from the scope of aspects of the invention, it is intended that all matter contained in the above description shall be interpreted as illustrative and not in a limiting sense. Reference to particular illustrative embodiments should not be construed as limitations. The inventive devices, products, and methods can be adapted for other uses or provided in other forms not explicitly listed above, and can be modified in numerous ways within the spirit of the present disclosure. Thus, the present invention is not limited to the disclosed embodiments, but is to be accorded the widest scope consistent with the claims below.

I claim:

1. A forward wheel apparatus for a wheelchair, the wheelchair comprising rear wheels, forward wheels, a primary frame having a first side and a second side, the primary frame connected to the rear wheels and the forward wheels, a seat attached to the primary frame and disposed between the first and second sides, the first side comprising a portion to which the forward wheel apparatus is releasably securable, the forward wheel apparatus comprising:

a. a caster having a pivot axis;

b. a forward wheel support attached to the caster;

c. a mounting member comprising a first opening to receive the forward wheel support, the mounting member further comprising a second opening to receive a pin for aligning the forward wheel support in an orientation relative to the mounting member, and the mounting member further comprising a clamp to facilitate releasable securing of the forward wheel apparatus to the portion;

wherein the pivot axis of the caster is securable in a desired orientation relative to the wheelchair, and wherein attaching the forward wheel apparatus to the portion leaves a substantially unobstructed opening for a user to pass through while transferring into or out of the wheelchair.

2. The forward wheel apparatus for a wheelchair of claim 1, wherein the pivot axis of the caster is securable in a substantially vertical orientation.

3. The forward wheel apparatus for a wheelchair of claim 1, wherein the caster is adjustably securable in a lateral position.

4. The forward wheel apparatus for a wheelchair of claim 1, wherein the caster is adjustably securable to the forward wheel support.

5. The forward wheel apparatus for a wheelchair of claim 1, wherein the forward wheel support is nonlinear.

6. The forward wheel apparatus for a wheelchair of claim 1, further comprising an elastomeric member that is in contact with the portion.

7. The forward wheel apparatus for a wheelchair of claim 1, wherein the forward wheel apparatus may be releasably attached to the wheelchair in a stowed position.

8. A forward wheel apparatus for a wheelchair, the wheelchair comprising a primary frame, a pair of rear drive wheels and a pair of primary caster wheels, the forward wheel apparatus comprising:

a. a forward wheel support having first and second end portions and a wheel, said wheel being detachably attached to the second end portion;

b. a mounting member including a receptacle, wherein the first end portion is releasably inserted into the receptacle;

c. an alignment element located on the first end portion for preventing the forward wheel support from rotating within the receptacle, wherein a desired orientation of the wheel is secured relative to the mounting member; and wherein the wheel may be adjustably secured to the wheelchair in a substantially vertical position.

9. The forward wheel apparatus for a wheelchair of claim 8, wherein fastening the forward wheel attachment to the wheelchair substantially lengthens the wheelchair to provide increased forward stability and to facilitate traversal over rugged terrain by the user.

10. The forward wheel apparatus for a wheelchair of claim 8, wherein the mounting member further includes an attachment means for releasably attaching the first mounting member to the wheelchair.

11. The forward wheel apparatus for a wheelchair of claim 10, wherein securing the forward wheel apparatus to the wheelchair and engaging the wheel with a ground surface distributes a portion of a load supported by the wheelchair to the forward wheel apparatus and relieves the load from the primary caster wheels.

12. The forward wheel apparatus for a wheelchair of claim 11, wherein securing the forward wheel apparatus to the wheelchair leaves a central forward region between the wheel and the primary frame substantially unobstructed such that a user can pass through the central forward region in the process of transferring into or out of the wheelchair.

13. The forward wheel apparatus for a wheelchair of claim 8, wherein securing the forward wheel apparatus to the wheelchair and engaging the wheel with a ground surface distributes a portion of a load supported by the wheelchair to the forward wheel apparatus and relieves the load from the primary caster wheels.

14. The forward wheel apparatus for a wheelchair of claim 13, wherein securing the forward wheel apparatus to the wheelchair leaves a central forward region between the wheel and the primary frame substantially unobstructed such that a user can pass through the central forward region in the process of transferring into or out of the wheelchair.

15. The forward wheel apparatus for a wheelchair of claim 8, wherein securing the forward wheel apparatus to the wheelchair leaves a central forward region between the wheel and the primary frame substantially unobstructed such that a user can pass through the central forward region in the process of transferring into or out of the wheelchair.

16. The forward wheel apparatus for a wheelchair of claim 15, wherein the mounting member further includes an attachment means for releasably attaching the first mounting member to the wheelchair.

17. A conversion means for a wheelchair, the wheelchair comprising rear wheels, conventional casters, a primary frame connected to the rear wheels and the conventional casters, a seat attached to the primary frame, the primary frame comprising a portion to which a releasable wheel assembly may be attached, the conversion means comprising:

a. the releasable wheel assembly including a forward wheel support and a mounting member;

b. the forward wheel support having first and second end portions and a wheel, said wheel being detachably attached to the second end portion;

c. the mounting member including a receptacle, and the first end portion being releasably connected to the receptacle, and wherein the mounting member fastens the releasable wheel assembly to the portion;

d. means for preventing rotation of the first end portion relative to the receptacle;

wherein the conversion means may share in load-bearing with the conventional casters or may fully relieve the conventional casters from load-bearing, and wherein the releasable wheel assembly may be adjustably fastened in a desired angular orientation relative to the primary frame.

18. The conversion means for a wheelchair of claim 17, wherein the mounting member is permanently affixed to the wheelchair.

19. The conversion means for a wheelchair of claim 17, the conversion means further comprising a quick-release clamp.

20. The conversion means for a wheelchair of claim 17, wherein the releasable wheel assembly may be fastened to the wheelchair in a stowed position.

* * * * *